US006755680B2

(12) United States Patent
Okamura et al.

(10) Patent No.: US 6,755,680 B2
(45) Date of Patent: Jun. 29, 2004

(54) FIXTURE DEVICE FOR USE IN CONNECTION OF FLAT WIRE MEMBER WITH TERMINAL CONNECTOR

(75) Inventors: Kenji Okamura, Nagoya (JP); Hiroki Hirai, Nagoya (JP); Yoshito Sakai, Nagoya (JP)

(73) Assignees: Autonetworks Technologies, Ltd., Nagoya (JP); Sumitomo Wiring Systems, Ltd., Mie (JP); Sumitomo Electric Industries, Ltd., Osaka (JP)

( * ) Notice: Subject to any disclaimer, the term of this patent is extended or adjusted under 35 U.S.C. 154(b) by 101 days.

(21) Appl. No.: 10/043,250

(22) Filed: Jan. 14, 2002

(65) Prior Publication Data

US 2002/0098733 A1 Jul. 25, 2002

(30) Foreign Application Priority Data

Jan. 19, 2001 (JP) ..... 2001-011327
Feb. 16, 2001 (JP) ..... 2001-040178
Oct. 23, 2001 (JP) ..... 2001-325339

(51) Int. Cl.[7] ..... H01R 13/00
(52) U.S. Cl. ..... 439/483
(58) Field of Search ..... 439/483, 492, 439/493–499, 260, 372, 160, 157, 153, 155, 358

(56) References Cited

U.S. PATENT DOCUMENTS 3,853,380 A * 12/1974 Baker ..... 439/358
4,469,388 A * 9/1984 Narozny ..... 439/153
4,973,255 A * 11/1990 Rudoy ..... 439/157
5,738,545 A * 4/1998 Igarashi et al. ..... 439/607
6,066,000 A * 5/2000 Masumoto et al. ..... 439/607
6,203,346 B1 * 3/2001 Wu et al. ..... 439/260
6,386,905 B1 * 5/2002 Ito ..... 439/495
6,475,025 B2 * 11/2002 Inoue ..... 439/495
6,520,797 B2 * 2/2003 Okamura et al. ..... 439/495
2002/0076975 A1 * 6/2002 Sakai et al. ..... 439/495
2002/0094717 A1 * 7/2002 Sakai et al. ..... 439/495
2002/0146932 A1 * 10/2002 Yamatani et al. ..... 439/495

* cited by examiner

*Primary Examiner*—Ross Gushi
(74) *Attorney, Agent, or Firm*—Oliff & Berridge, PLC

(57) ABSTRACT

A fixture device for use in connection of a flat wire member of a terminal connector is so constructed as to bring conductors of a flat wire member into contact with terminals by mounting a connector at an end portion of the flat cable and connecting the fixture device with a connector mounted on a circuit board to insert the end portion of the flat cable into the connector. The connector is provided with a pair of pivotally changeable handles. The handles extend in a direction opposite from an engaging direction of the connector with the connector while standing upright with respect to the rear end surface of the connector. Then operability in connecting or detaching the flat wire member can be improved.

22 Claims, 33 Drawing Sheets

FIXTURE DEVICE FOR USE IN CONNECTION OF FLAT WIRE MEMBER WITH TERMINAL CONNECTOR

BACKGROUND OF THE INVENTION

This invention relates to a fixture device for use in electrical connection of a flat cable, a ribbon wire, a FPC (flexible printed circuit) or like flat wire member, in which flat rectangular conductors are arrayed side by side, with a circuit board or the like.

There has been generally known a connector assembly for flat wire member which assembly is comprised of a connector for circuit board (terminal-side connector) which accommodates a plurality of terminals side by side and is to be mounted on a circuit board, and a mating connector (wire-side connector) to be mounted on an end portion of a flat wire member such as a flat cable, the flat wire member being connected with the circuit board by connecting the two connectors.

In such a connector assembly, the flat wire member has its end portion processed to expose conductors to outside, and this end portion is supported on a plate-shaped supporting member provided in the wire-side connector. When the two connectors are connected, the end portion of the flat wire member is inserted together with the supporting member into the terminal-side connector to bring the respective conductors into contact with the terminals. As a result, the respective conductors of the flat wire member and patterns on the circuit board are electrically connected.

Electrical connection of audio equipments installed in an automotive vehicle is, for example, thought as one of applications of the connector assembly for flat wire member as above.

As automotive vehicles have come to possess more functions in recent years, the number of such audio equipments is on the increase, forcing the audio equipments to be laid out in a limited narrow space. Thus, at the time of assembling, repairing and inspecting the audio equipment, the flat wire member needs to be inserted and detached in a narrow space.

However, in many cases, the detaching operation cannot be performed in such a narrow space by gripping the connector fast, making the insertion and detachment of the flat wire member difficult. Particularly, if the connector assembly is small, the inserting and detaching operations are even more difficult. Therefore, it is desired to solve this problem from the structural aspect of the connector assembly.

In addition to the above type of the connector assembly for flat wire member in which the two connectors are connected with each other, there is, for example, a connector assembly of the type in which conductors of the flat wire member are brought into contact with terminals by directly inserting an end portion of the flat wire member into the terminal-side connector and placing a plate-shaped member called slider on or under this end portion of the flat wire member. In the connector assembly of this type, the slider needs to be inserted and detached upon inserting and detaching the flat wire member. The inserting or detaching operation may not be performed in a narrow space by gripping the slider fast. Similar to the connector assembly of the former type, it is difficult to insert and detach the flat wire member.

SUMMARY OF THE INVENTION

It is an object of the present invention to provide a fixture device for use in connection of a flat wire member with a terminal connector which is free from the problems residing in the prior art.

According to an aspect of the invention, a fixture device is used in connection of a flat wire member with a terminal-side connector for accommodating terminals. The fixture device comprises: a housing having a shape engageable with the terminal-side connector for holding conductors of a flat wire member in contact with the terminals when the housing is placed in the terminal-side connector; and a handle changeable between an accommodated position and a used position, the handle extending in a direction opposite from an engaging direction of the housing with the terminal-side connector when the handle is located at the used position.

These and other objects, features and advantages of the present invention will become more apparent upon a reading of the following detailed description and accompanying drawings.

DETAILED DESCRIPTION OF THE PREFERRED EMBODIMENTS OF THE PRESENT INVENTION

Figure 1:
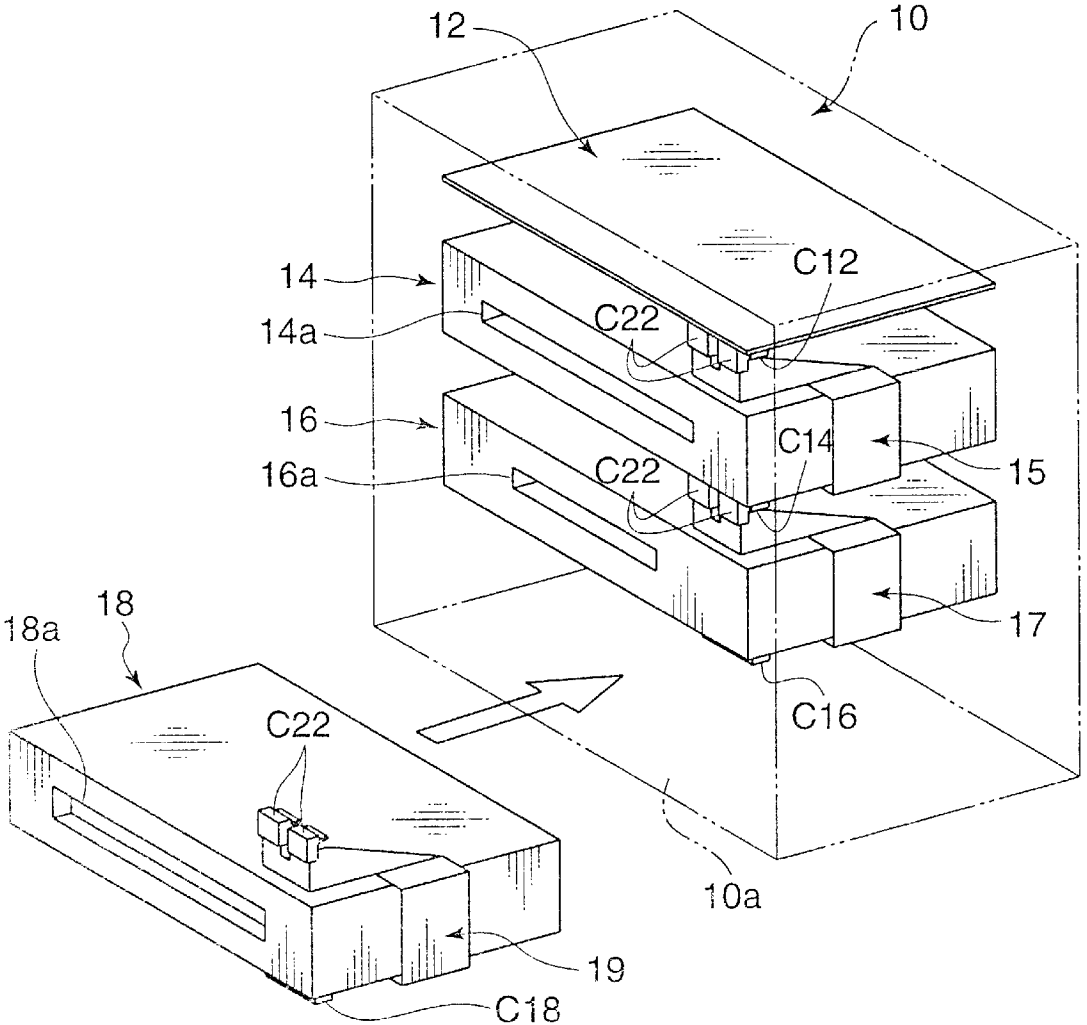
FIG. 1 is a perspective view showing an audio unit to be installed in an automotive vehicle to which a connector assembly for flat wire member according to an embodiment of the invention is applied.

An embodiment of the present invention is described with reference to the accompanying drawings. FIG. 1 schematically shows an audio unit to be installed in an automotive vehicle, embodying the invention. In FIG. 1, identified by 10 is a casing having openings at its front and rear sides, and a main circuit board 12 for centrally controlling this unit, a CD player 14, a MD (mini-disc) player 16 and a CS (cassette) player 18 are accommodated and fixed in this order from above inside this casing 10.

The respective players 14, 16, 18 have insertion openings 14*a*, 16*a*, 18*a* for corresponding media, and are accommodated in the casing 10 such that these insertion openings 14*a*, 16*a*, 18*a* face a front opening 10*a* of the casing 10. These players 14, 16, 18 are assembled in a passenger's compartment with the insertion openings 14*a*, 16*a*, 18*a* thereof faced toward the passenger's compartment by mounting the casing 10 on an instrument panel from behind. Thus, the media can be inserted and taken out in the passenger's compartment. Though not shown, a panel (execution panel) provided with operable members for operating the respective players 14, 16, 18 is mounted on the front side of the casing 10.

The respective players 14, 16, 18 are provided with flat wire members 15, 17, 19 for electrical connection (flat cables in this embodiment: hereinafter referred to as cables 15, 17, 19) and connectors C14, C16, C18 (terminal-side connectors). By connecting the cables 15, 17, 19 of the players 14, 16, 18 with the connectors C12, C14, C16 of the main circuit board 12 or the players 14, 16, 18 located vertically adjacent with the main circuit board 12 and the players 14, 16, 18 accommodated while being vertically arranged as described above, the players 14, 16, 18 are electrically connected in a chain with the main circuit board 12.

The respective connectors C14, C16, C18 of the players 14, 16, 18 and the respective cables 15, 17, 19 have the same construction, so that, even if the players 14, 16, 18 are rearranged or any of them is omitted, they are connectable with each other. Hereinafter, these constructions are described, taking the CD player 14 as an example.

Figure 2:
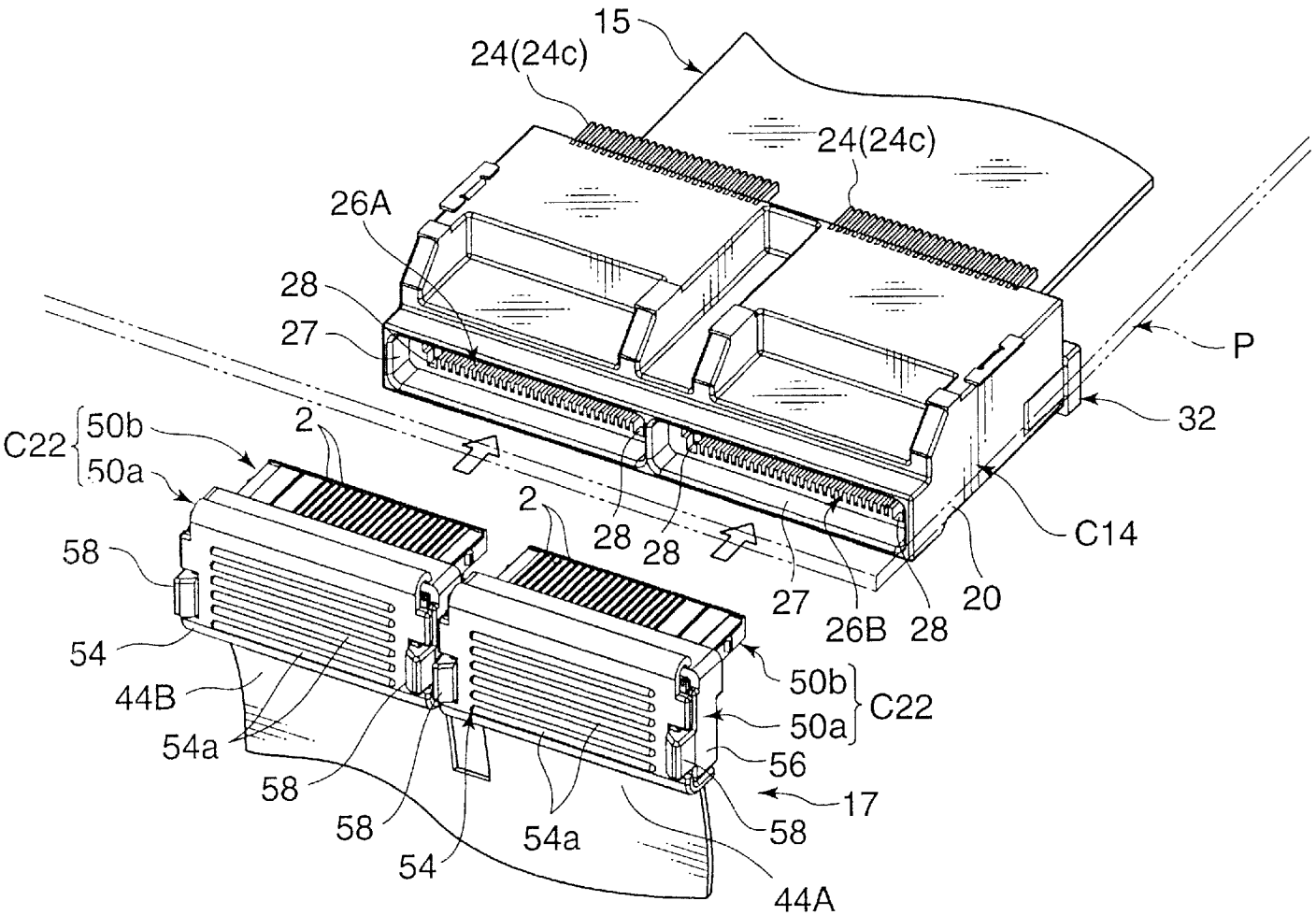
FIG. 2 is a perspective view showing a terminal-side connector to be mounted on a circuit board of a CD player and a wire-side connector for a flat cable to be connected with the terminal-side connector.
Figure 3:
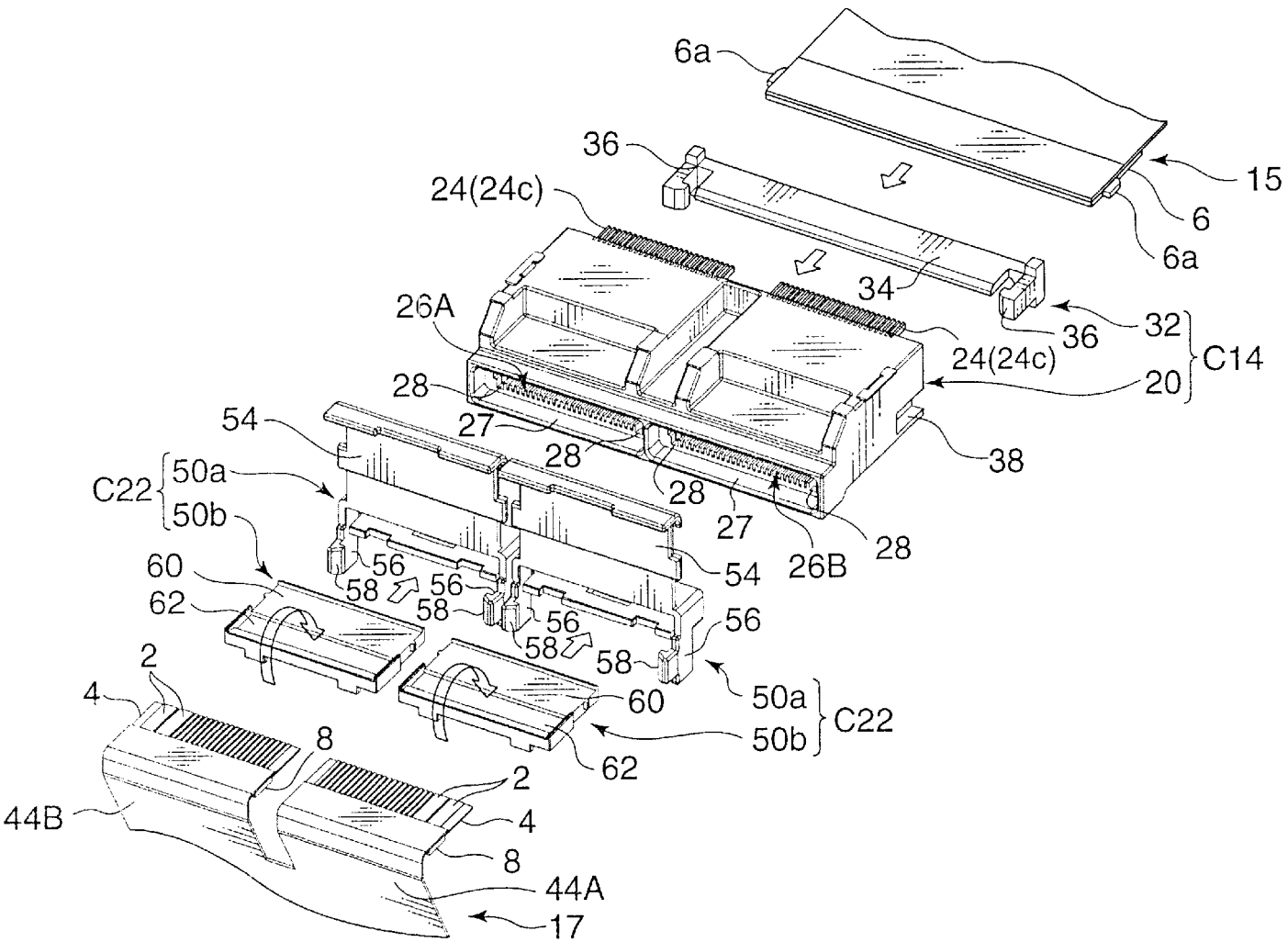
FIG. 3 is an exploded perspective view showing the terminal-side and wire-side connectors.
Figure 4A:
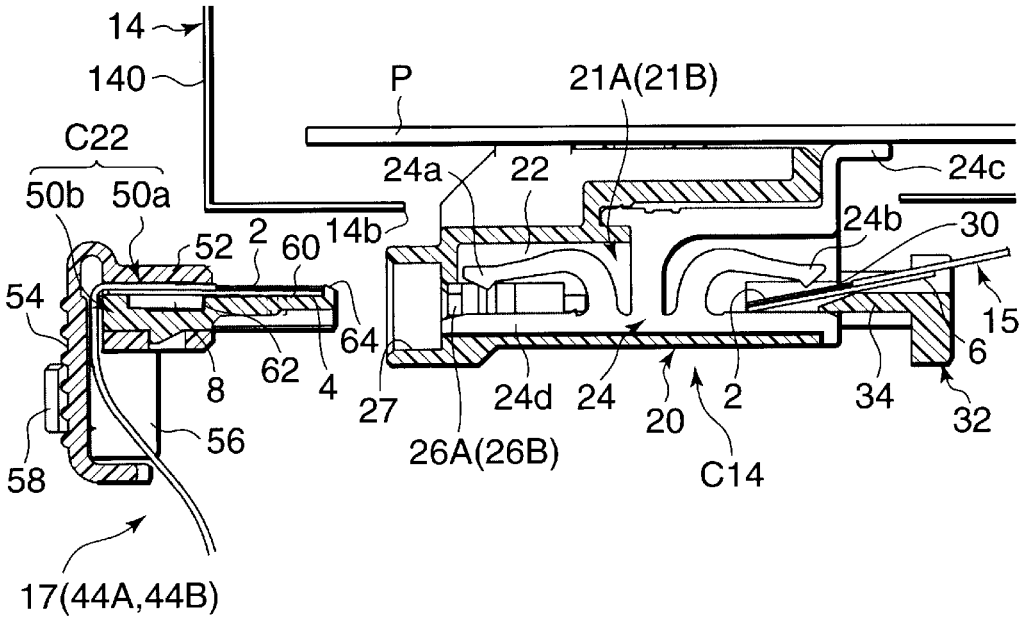
FIGS. 4A and 4B are sections showing constructions of the terminal-side and wire-side connectors prior to and at an intermediate stage of connection of the two connectors, respectively.

As shown in FIGS. 2, 3 and 4A, the CD player 14 has a circuit board P inside its casing 140 (see FIG. 4A), and the connector C14 is provided on the lower surface of the circuit board P. The connector C14 is a connector for circuit board, is secured to the circuit board P by being mounted and is exposed to outside at the bottom side of the CD player 14 via an opening 14*b* formed in the casing 140.

The connector C14 is formed at its front side (left side in FIG. 4A) with a section to be connected with the cable 17 of the MD player 16, and the cable 15 of the CD player 14 is fixedly inserted at its rear side.

Figure 6:
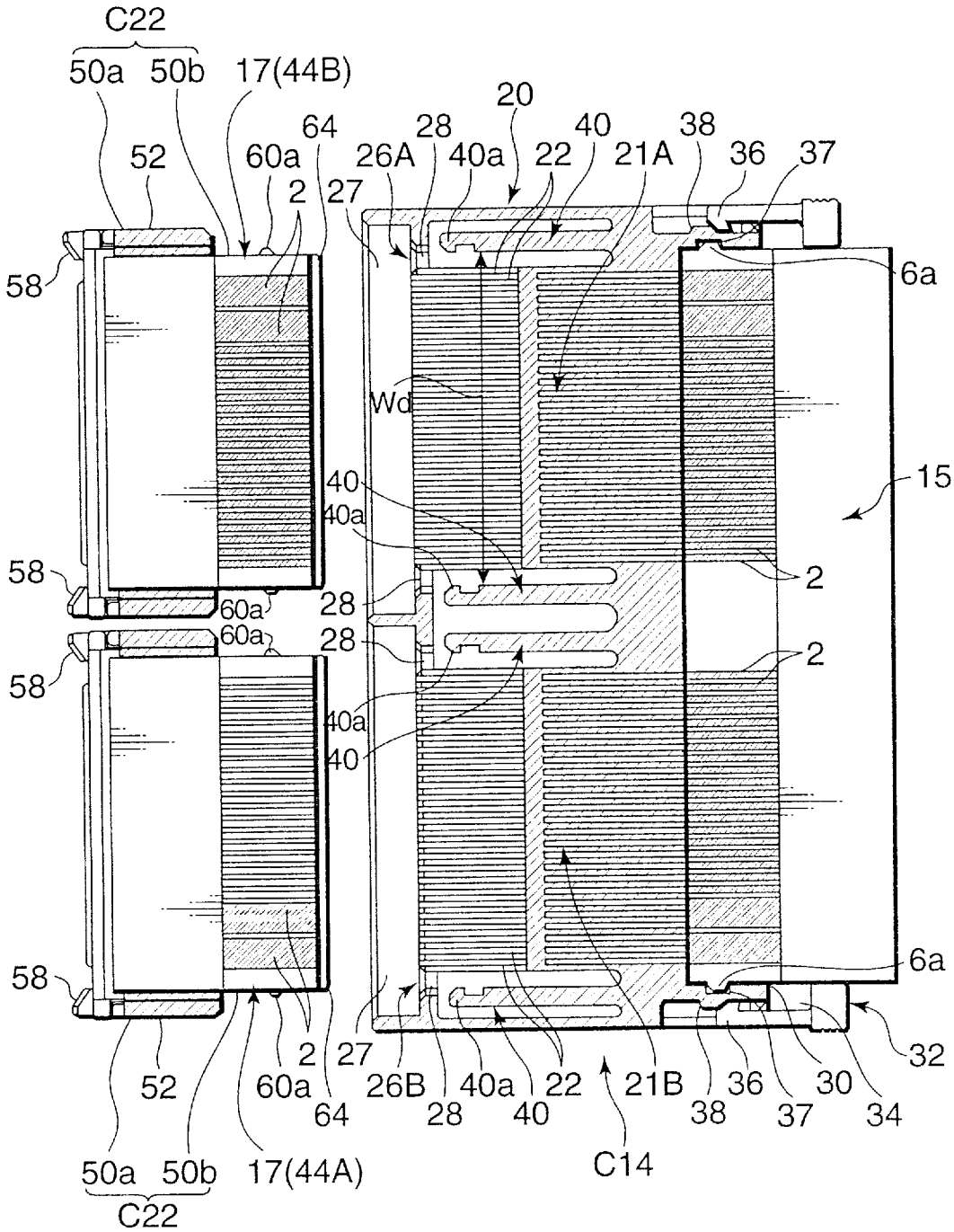
FIG. 6 is a sectional view showing constructions of the terminal-side and wire-side connectors.

More specifically, the connector C14 has a female housing 20 narrow in the widthwise direction of the CD player 14 (direction normal to the plane of FIG. 4A: hereinafter referred to merely as widthwise direction). This housing 20 is formed with two connection sections 21A, 21B separated along the widthwise direction (vertical direction in FIG. 6) as shown in FIG. 6.

A plurality of cavities 22 are formed side by side along the widthwise direction in each connection section 21A, 21B, and terminals 24 (see FIG. 4A; not shown in FIG. 6) are accommodated in the respective cavities 22. As shown in FIG: 4A, each terminal 24 is comprised of a bottom portion 24*d* extending in forward and backward directions along the bottom of the cavity 22, resiliently deformable pieces 24*a*, 24*b* for connection which extend forward and backward from a middle portion of the bottom portion 24*d* and are vertically resiliently changeable, and a leg portion 24*c* extending obliquely upward to the back from the middle between the resiliently deformable pieces 24*a* 24*b*. Each terminal 24 is electrically connected with a circuit on the circuit board by the leg portion 24*c* thereof being soldered to a land or the like (not shown) on the circuit board P.

In the front surface of the housing 20, insertion openings 26A, 26B for the cable (cable 17 of the MD player 16) corresponding to the respective connection sections 21A, 21B are independently formed. During connection of the cable 17, connectors C22 of the cable 17 to be described later are inserted into the housing 20 through these insertion openings 26A, 26B to bring the respective conductors of the cable 17 into contact with the front resiliently deformable pieces 24*a* of the respective terminals 24. In other words, in the first embodiment, the connector assembly for the flat wire material according to the present invention is formed by the connector C14 (C12, C16, C18) and the connectors C22.

Tubular hoods 27 are formed around the respective insertion openings 26A, 26B, and the connectors C22 of the cable 17 are fitted into these hoods 27 during connection of the cable 17. Further, guide grooves 28 for guiding the connectors C22 of the cable 17 are formed at the opposite widthwise ends of the respective insertion openings 26A, 26B.

On the other hand, the rear surface of the housing 20 is formed with an insertion opening 30 narrow in widthwise direction and common to the both connection sections 21A, 21B, and a slider 32 is insertably and detachably supported in this insertion opening 30.

As shown in FIG. 3, the slider 32 is a narrow member extending in the widthwise direction of the housing 20, and includes a tongue 34 extending in its longitudinal direction and fixing hooks 36 at its opposite ends. The slider 32 is inserted into the housing 20 through the insertion opening 30 together with the cable 15 while being placed on the cable 15, and is attached to the housing 20 by engaging the hooks 36 with projections 38 formed on the side walls of the housing 20, thereby fixing the cable 15 inserted into the connector C14. A method for fixing the cable 15 is described in detail later.

Inside the housing 20 of the connector C14, a pair of locking pieces 40 resiliently deformable in widthwise direction are provided near the respective insertion openings 26A, 26B and at the opposite outer sides of the respective connection sections 21A, 21B as shown in FIG. 6. Each locking piece 40 is provided with a hook 40*a* at its leading end (left end in FIG. 6). When the connectors C22 mounted on the cable 17 are inserted into the housing 20 through the respective insertion openings 26A, 26B, the hooks 40*a* are engaged with locking portions 60*a* of the connectors C22 to be described later.

Figure 7:
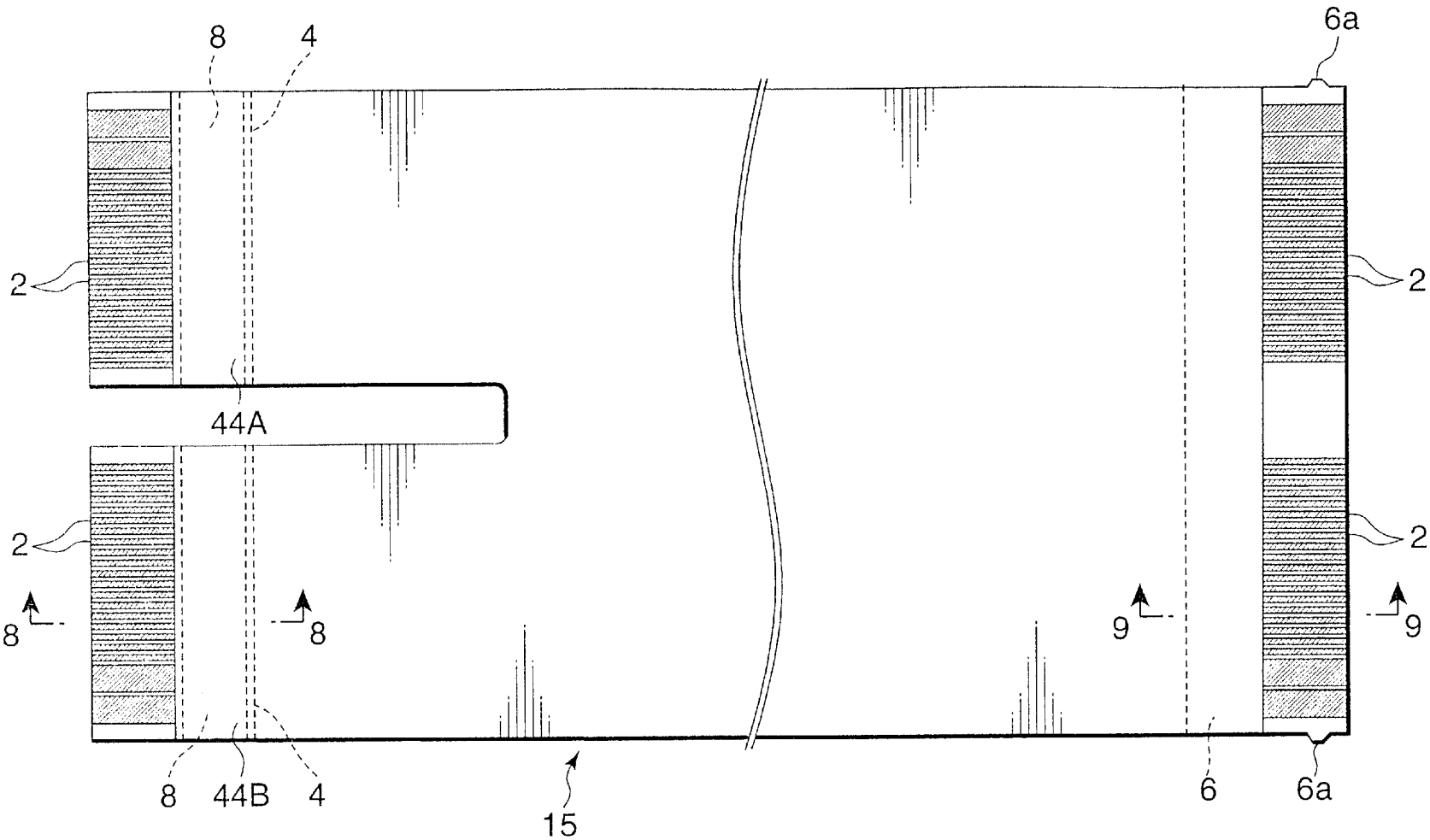
FIG. 7 is a plan view showing a construction of the flat cable.
Figure 8:
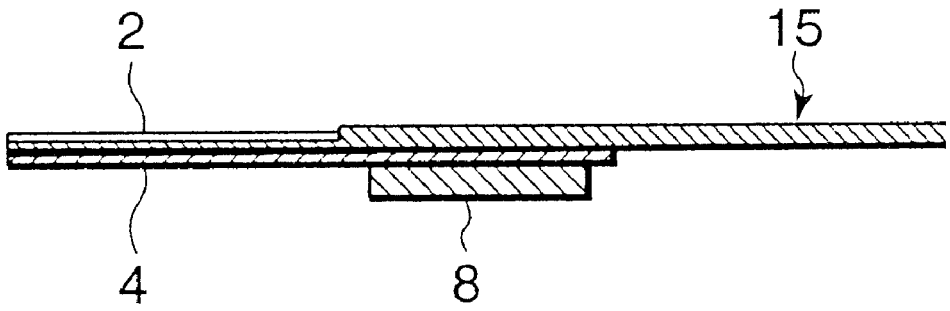
FIG. 8 is a sectional view along the line 8—8 in FIG. 7 showing the construction of the flat cable.
Figure 9:
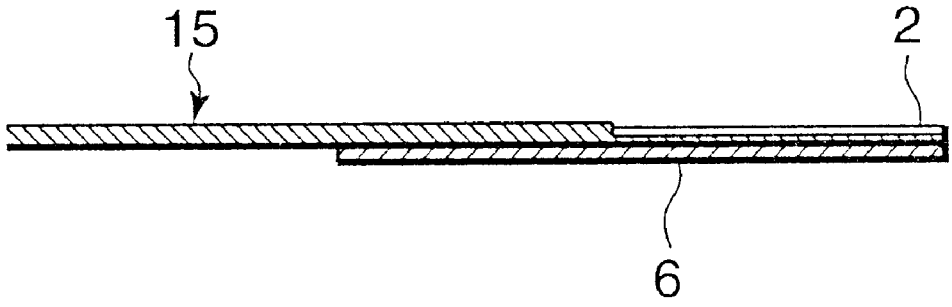
FIG. 9 is a sectional view along the line 9—9 in FIG. 7 showing the construction of the flat cable.

As shown in FIGS. 7 to 9, the cable 15 takes a forked structure by cutting away a middle portion (widthwise middle portion) of one end portion (left end portion of FIG. 7) to split this end portion into split pieces 44A, 44B. Ends of the cable 15 (i.e., end where the split pieces 44A, 44B are located and an end opposite therefrom) are processed to expose conductors 2, and reinforcing plates 4, 6 for restricting the deformation of the cable end portions are secured to the rear surfaces of these end portions. Positioning plates 8 are additionally secured to the reinforcing plates 4 of the split pieces 44A, 44B at a position more backward (rightward in FIG. 8) than the exposed sections of the conductors 2.

Figure 4B:
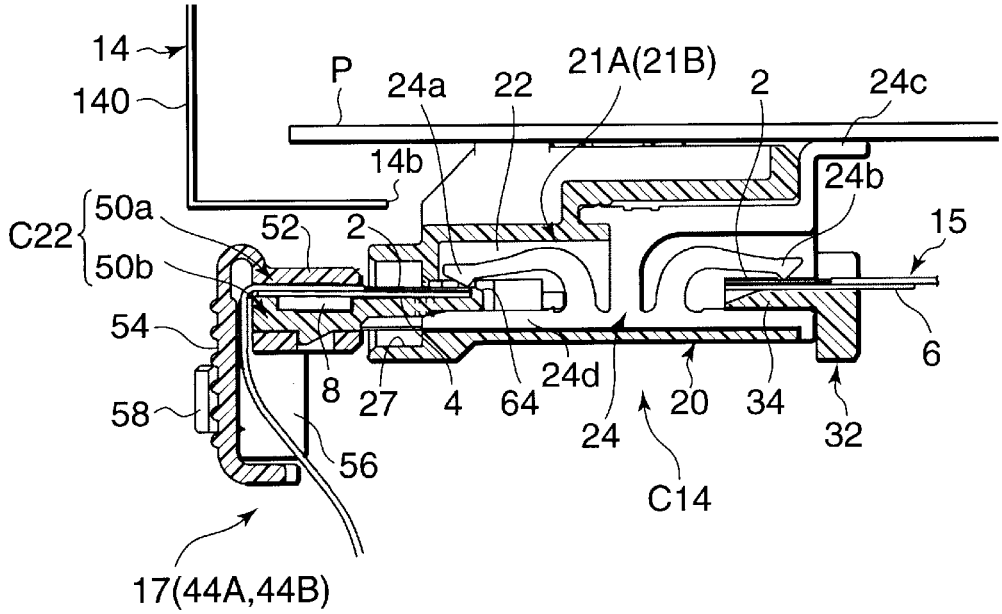

The cable 15 is connected with and fixed to the connector C14 with the end thereof opposite from the split pieces 44A, 44B inserted into the housing 20 through the insertion opening 30 in the rear surface of the connector C14. Specifically, after the end of the cable 15 is loosely fitted into the housing 20 through the insertion opening 30 in the rear surface as shown in FIG. 4A, the slider 32 is inserted into the housing 20 through the insertion opening 30 as shown in FIG. 4B. Then, the end of the cable 15 is pushed up by the tongue 34 of the slider 32, thereby fixing the conductors 2 of the cable 15 while holding them in contact with the deformable pieces 24*b* of the terminals 24 accommodated in the respective connection sections 21A, 21B. The respective conductors 2 of the cable 15 are connected with the circuits of the circuit board P via the terminals 24 by the contact thereof with the terminals 24. Partial locking projections 6*a* are formed at the opposite widthwise ends of the reinforcing plate 6 of the cable 15 as shown in FIG. 7. When the end of the cable 15 is loosely inserted into the housing 20 through the insertion opening 30 (state shown in FIG. 4A), the cable 15 can be partly locked in the housing 20 until the slider 32 is inserted by engaging the projections 6*a* with recesses 37 formed in the inner surfaces of the side walls of the housing 20 (see FIG. 6).

Although the conductors 2 are present at the middle portion (widthwise middle portion) of the cable 15 according to this embodiment, this middle portion of the cable 15 is a dead space over its longitudinal direction since the middle portion at one end portion is cut away to form the split pieces 44A, 44B as described above. Thus, the conductors 2 at the middle portion are also omitted as shown in FIG. 7 at the end of the cable 15 to be fixed to the connector C14 (i.e., end opposite from the split pieces 44A, 44B).

On the other hand, the connectors C22 (fixture devices; wire-side connectors) are mounted on the ends of the respective split pieces 44A, 44B of the cable 15 as shown in FIGS. 2 and 3. Although the connectors C22 are mounted on the cable 17 in FIGS. 2 and 3, since the cables 15, 17 have a common construction as described above, the cable 15 is described below, if necessary, with reference to FIGS. 2 and 3 for the sake of convenience.

Figure 10A:
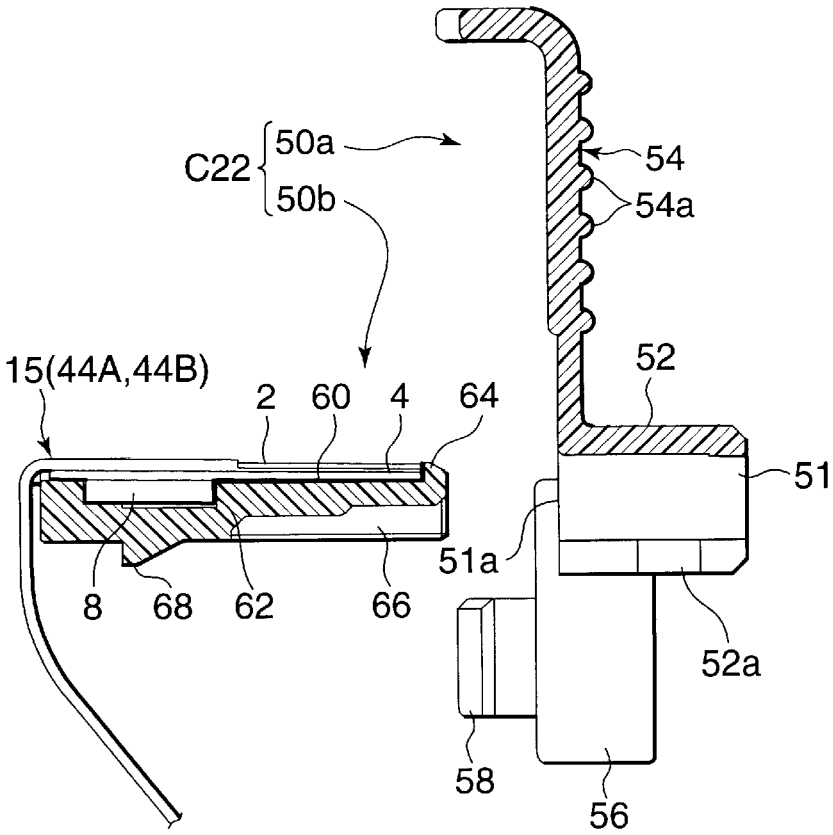
FIGS. 10A and 10B are sectional views showing construction of the wire-side connector before and after being connected or assembled with the flat cable, respectively.

Each connector C22 is comprised of a housing 50*a* and the holder 50*b* as shown in FIGS. 3 and 10A, and is mountable on the end of the split piece 44A (44B) of the cable 15 by inserting the holder 50*b* into the housing 50*a* while placing the holder 50*b* on the split piece 44A (44B).

Specifically, the housing 50*a* has a tubular shell portion 52 formed with an insertion hole 51 narrow in widthwise direction and penetrating in forward and backward directions (transverse direction in FIG. 10) into which hole the holder 50*b* and the like are insertable. This shell portion 52 is provided with a lock piece 54 in the form of a thin plate and serving as a handle at its rear end (left end in FIG. 10A) and at an upper part of an insertion opening 51*a* of the holder 50*b*. This lock piece 54 is vertically pivotal (bendable) about its base end between an exposure position to expose the insertion opening 51*a* (position shown in FIG. 10A) and a closing position to close the insertion opening 51*a* (accommodated position shown in FIG. 10B). By holding the lock piece 54 at a substantially horizontal position (used position) during its pivotal movement (see FIG. 13), the connector C22 extends in a direction opposite (left side in FIG. 4A) from the connecting direction thereof with the connector C14. The lock piece 54 has elongated projections 54*a* formed on its outer surface to prevent a slip.

Further, a pair of leg portions 56 are provided at the opposite widthwise ends of the shell portion 52. When the lock piece 54 is bent to reach the closing position, hooks 58 formed on the leg portions 56 are engaged with the lock piece 54 to lock the lock piece 54 at the closing position. In other words, the locking mechanism according to the present invention is formed by the hooks 58 and the like.

Figure 11:
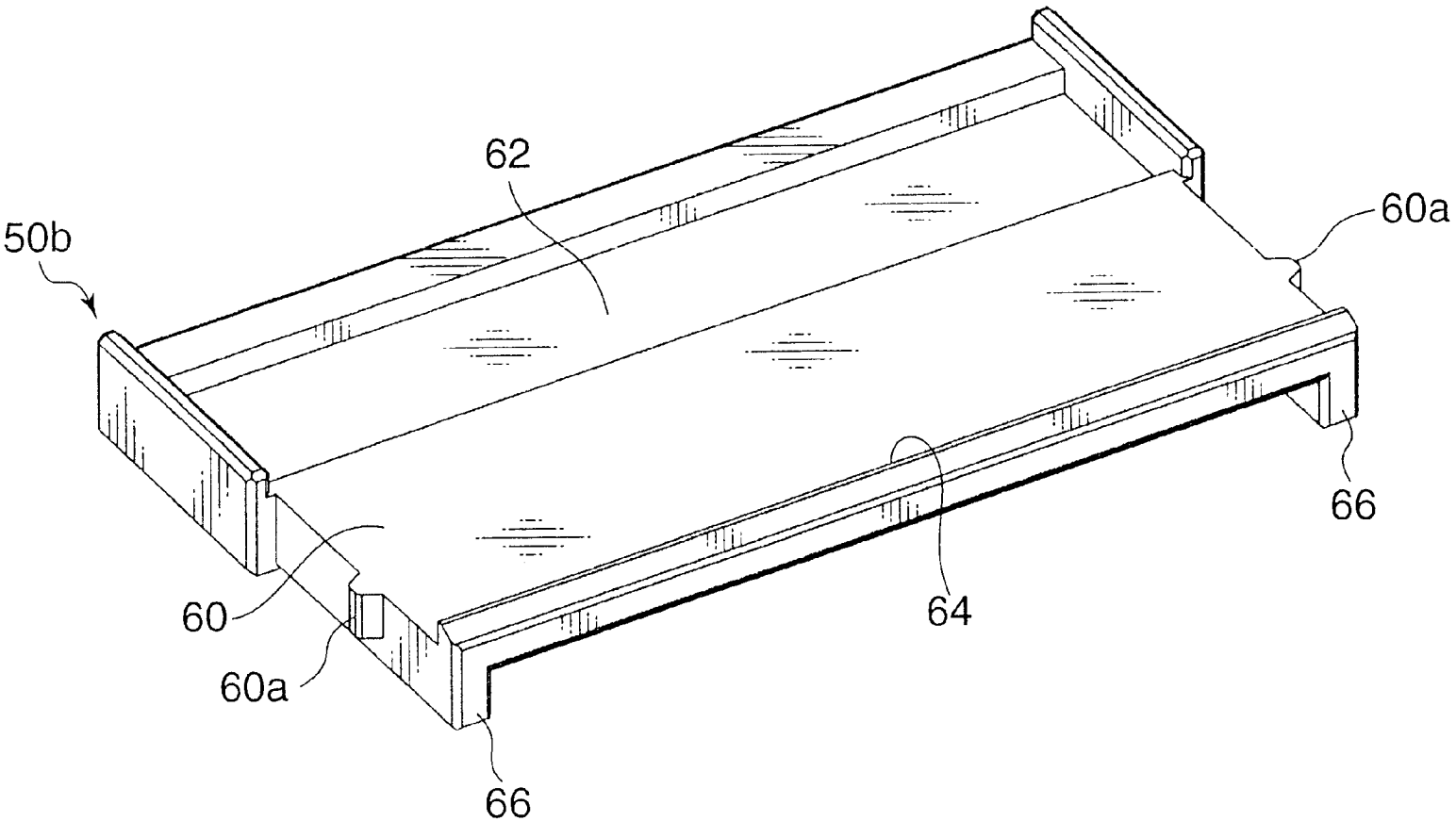
FIG. 11 is a perspective view of a holder forming the wire-side connector.

On the other hand, the holder 50*b* is a plate member having a flat alignment surface 60 on top as shown in FIG. 11, and is placed on the rear surface (reinforcing plate 4) of the split piece 44A(44B) via the alignment surface 60. A positioning recess 62 is formed at a rear part (left part in FIG. 10A) of the alignment surface 60 in order to restrict a displacement of the split piece 44A(44B) and the holder 50*b* by fitting the positioning plate 8 of the split piece 44A(44B) into the recess 62. An interference preventing rib 64 for protecting the cable 15 from interference during connection such as turning-up of the conductors 2 is formed at the leading end (right end in FIG. 10A) of the holder 50*b*.

The connector C22 is mounted on the split piece 44A (44B) as follows. The holder 50*b* is placed on the rear surface of the split piece 44A(44B) via the alignment surface 60 as shown in FIG. 10A, and the split piece 44A(44B) is inserted together with the holder 50*b* into the insertion hole 51 of the housing 50*a* from its leading end (i.e., from the rib 64 of the holder 50*b*) in this state. Then, the lock piece 54 is so bend as to close the insertion opening 51*a* of the housing 50*a*, and is locked by being pushed between the two hooks 58. In this way, the connector C22 is mounted on the split piece 44A(44B).

Figure 10B:
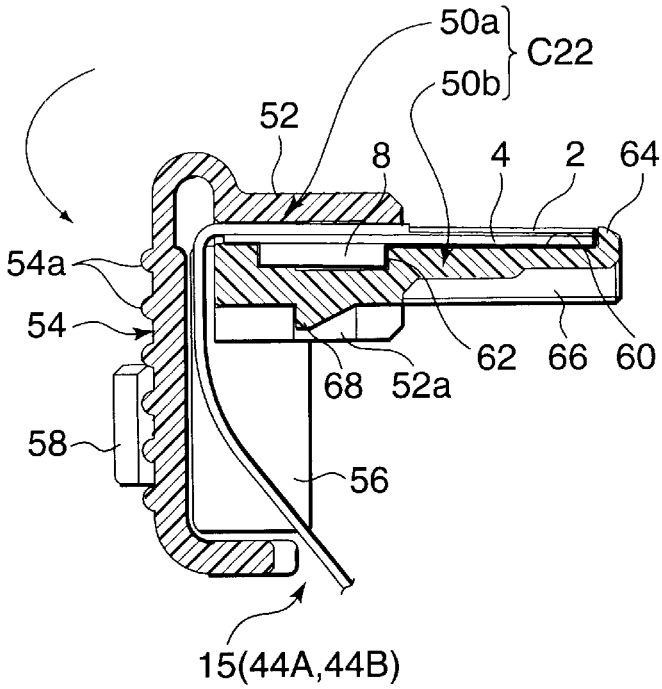

With the connector C22 mounted on the split piece 44A(44B), the exposed sections of the conductors 2 at the end of the split piece 44A(44B) are supported together with the holder 50*b* while projecting from the opposite side of the shell portion 52 of the housing 50*a* as shown in FIG. 10B. Further, as shown in FIG. 10B, a hook 68 formed on the rear surface of the holder 50*b* is engaged with a locking hole 52*a* formed in the inner bottom wall of the shell portion 52 of the housing 50*a*, with the result that the holder 50*b* is doubly locked in the housing 50*a* in cooperation with the lock piece 54 so as not to come out of the housing 50*a*.

The locking portions 60*a* project at the opposite widthwise ends of the holder 50*b* of the connector C22 as shown in FIG. 11, and a pair of guides 66 which are elongated projections extending in forward and backward directions (transverse direction in FIG. 10A) are provided at the opposite widthwise ends of the rear surface of the holder 50*b*.

The constructions of the connector C14, the cable 15 and the like are described above, taking the CD player 14 as an example. The connectors C16, C18, the cable 17, 19 and the like of the other players 16, 18 have the same constructions as the connector C14 and the cable 15 of the CD player 14. Further, the connector C12 to be mounted on the main circuit board 12 also has the same construction as the connector C14 of the CD player 14.

The cables 15, 17, 19 of the respective players 14, 16, 18 are bent as shown in FIG. 1, and are drawn to the tops of the front surfaces of the players 14, 16, 18 while being laid along the side surfaces of the players 14, 16, 18.

The audio unit as above is assembled as follows. First, the main circuit board 12, the CD player 14, the MD player 16 and the CS player 18 are fixed in a specified order in the casing 10, and the cables 15, 17, 19 of the respective players 14, 16, 18 are connected with the players or the like located right above. Specifically, the cable 15 of the CD player 14 is connected with the connector C12 of the main circuit board 12; the cable 17 of the MD player 16 with the connector C14 of the CD player 14; and the cable 19 of the CS player 18 with the connector C16 of the MD player 16.

Figure 12A:
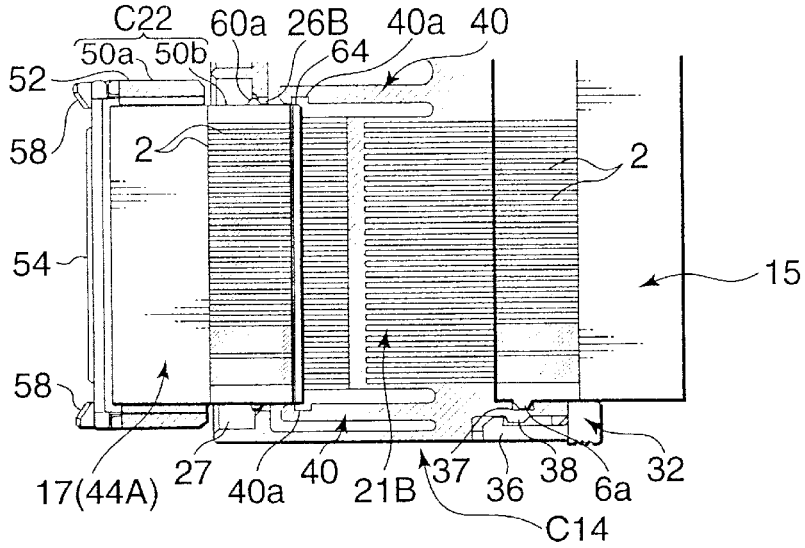
FIGS. 12A, 12B and 12C are sectional views showing constructions of the terminal-side and wire-side connectors, corresponding to FIGS. 4B, 5A and 5B, respectively.

For example, in the case of connecting the cable 17 of the MD player 16 with the connector C14 of the CD player 14, the respective connectors C22 of the cable 17 are opposed to the respective insertion openings 26A, 26B of the connector C14, and the projecting portions of the holders 50*b* of the respective connectors C22 are inserted into the insertion openings 26A, 26B from their leading ends as shown in FIGS. 4B and 12A. At this time, the connectors C22 are inserted into the insertion openings 26A, 26B while the guides 66 of the holders 50*b* are guided along the guide grooves 28 formed in the insertion openings 26A, 26B.

Figure 5A:
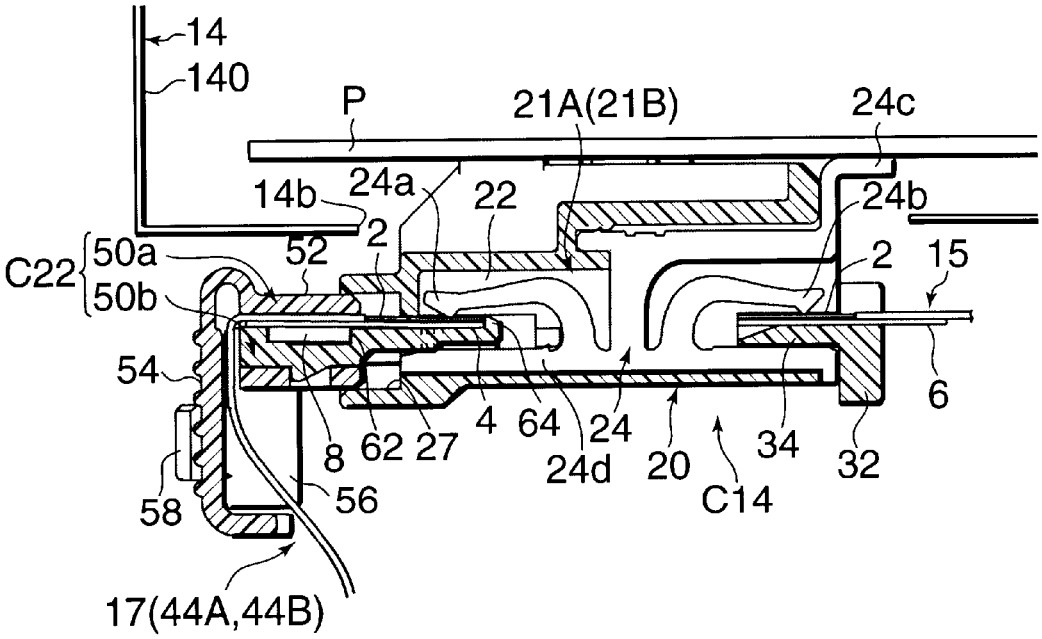
FIGS. 5A and 5B are sectional views showing constructions of the terminal-side and wire-side connectors at an intermediate stage of and after connection of the two connectors, respectively.
Figure 5B:
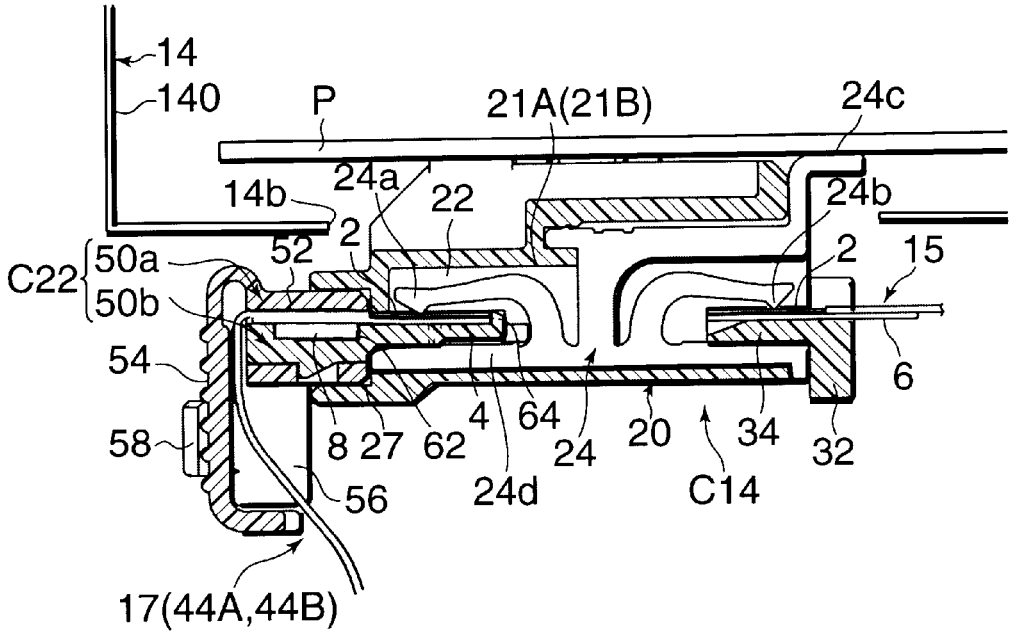
Figure 12B:
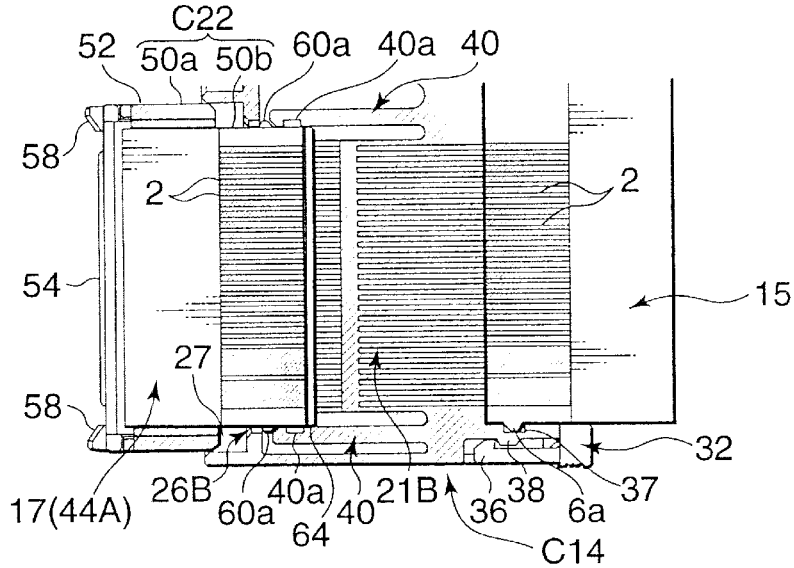
Figure 12C:
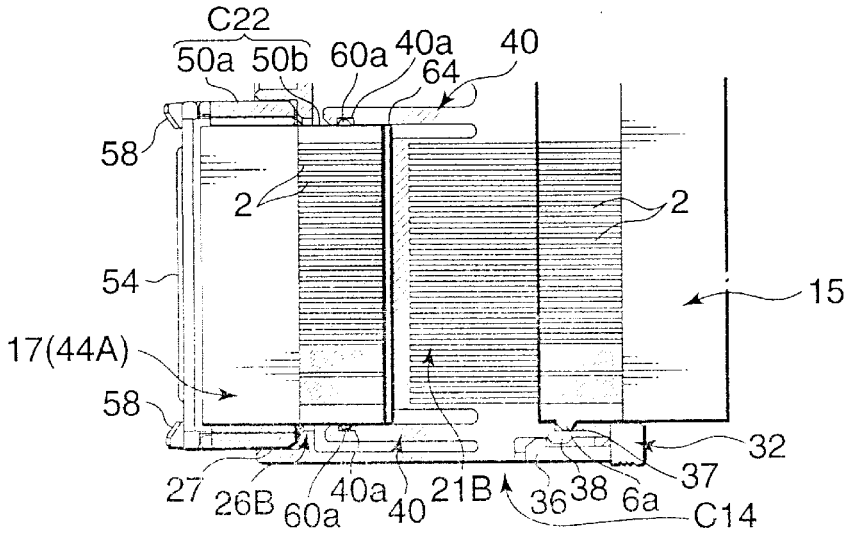

In this way, the housings 50*a* (shell portions 52) of the respective connectors C22 are fitted into the hoods 27 of the connector C14, i.e., a state shown in FIGS. 5A and 12A changes to a state shown in FIGS. 5B and 12B. As the connector C22 is inserted, a pair of locking pieces 40 inside the connector C14 are pushed wider apart by the locking portions 60*a* formed on the holder 50*b*. When the holder 50*b* is inserted to the back end of the connector C22, the hooks 40*a* of the respective locking pieces 40 are engaged with the corresponding locking portions 60*a* of the holder 50*b*, with the result that each connector C22 is locked into the connector C14. Each locking portion 60*a* of the holder 50*b* is formed into such a substantially trapezoidal shape in plan view which is tapered from its base end toward its leading end. Accordingly, this locked state is a so-called "semi-locked" state and, when being pulled in a withdrawing direction with a specified force or larger, the connector C22 can be detached from the connector C14 while being unlocked.

When the connectors C22 are thus connected with the connector C14, the exposed sections of the conductors 2 of the cable 17 are inserted into the connection sections 21A, 21B of the connector C14 together with the holder 50*b*, thereby being brought into contact with the deformable pieces 24*a* of the respective terminals 24. By this contact, the respective conductors 2 of the cable 17 are connected with the circuits of the circuit board P of the CD player 14 via the terminals 24, and corresponding pairs of the conductors 2 of the cable 15 of the CD player 14 connected with the rear surface of the connector C14 and those of the cable 17 are connected via the terminals 24.

Figure 13:
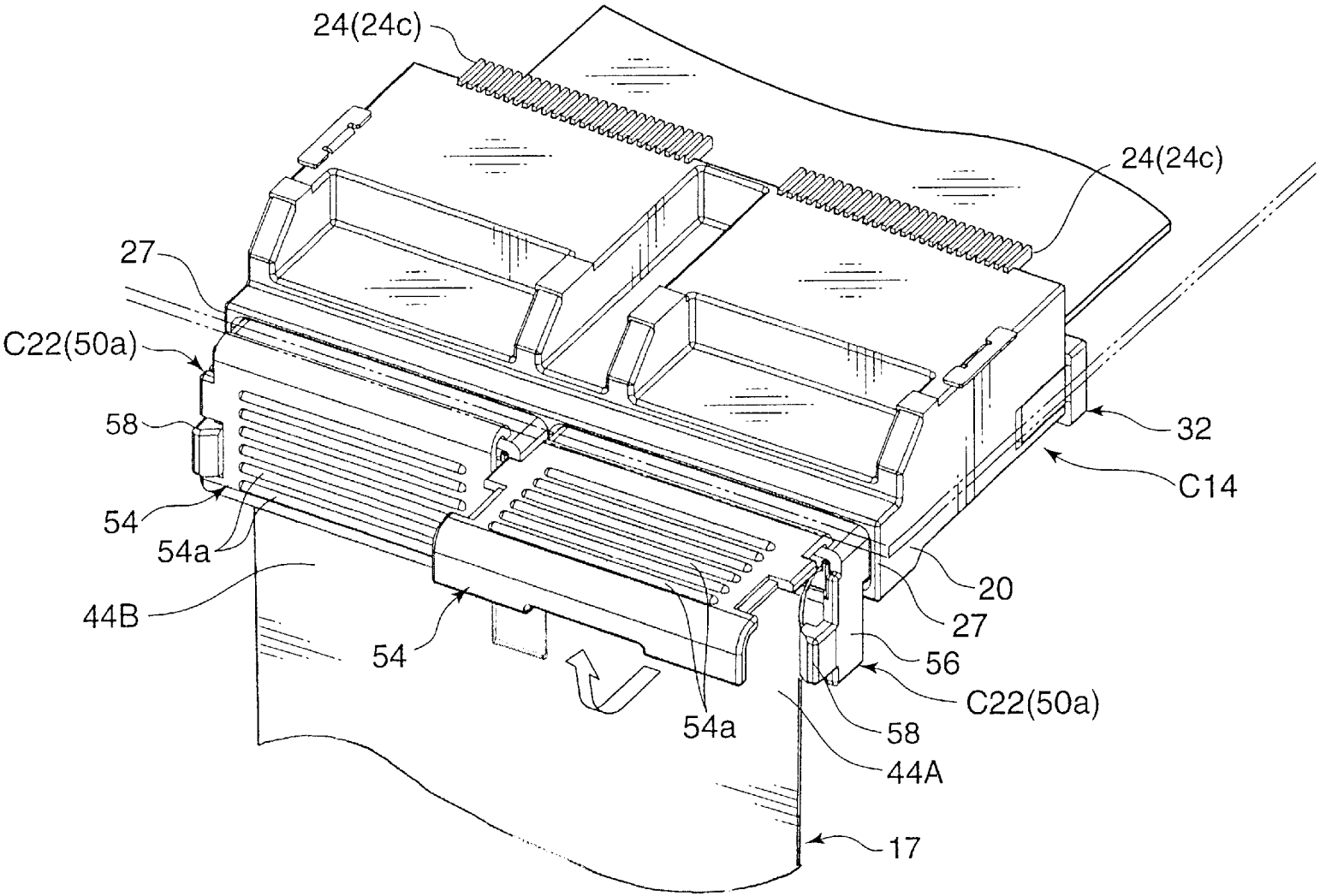
FIG. 13 is a perspective view showing a connected state of the terminal-side and wire-side connectors.

In the operation of connecting the cable 15, etc. with the main circuit board 12, etc., if, for example, the connectors C22 are small-size connectors or are spatially restricted, the lock pieces 54 of the connectors C22 are disengaged (unlocked) as shown in FIG. 13 and the connecting operation can be performed by gripping the lock pieces 54 with fingertips or pliers. By doing so, the connectors C22 are easier to grip, enabling the connecting operation to be more smoothly performed. In such a case, there is no likelihood that the holder 50*b* comes out of the housing 50*a* since the holder 50*b* is engaged with the housing 50*a* via the hooks 68 even if the lock piece 54 is disengaged.

The respective players 14, 16, 18 can be connected with the main circuit board 12 in a chain by connecting the cables 15, 17, 19 with the respective players located vertically adjacent to each other.

As described above, in this audio unit, the main circuit board 12 and the respective players 14, 16, 18 vertically arrayed are electrically connected in a chain by the cables 15, 17, 19 provided in the players 14, 16, 18. The ends of the cables 15, 17, 19 of the players 14, 16, 18 take a forked structure (split into the split pieces 44A, 44B), and the connectors C22 are mounted on the splits pieces 44A, 44B.

On the other hand, the connectors C12, C14, C16, C18 each having two connection sections 21A, 21B corresponding to the connectors C22 are provided as mating connectors. Thus, even in the case that the cables 15, 17, 19 have quite a number of conductors 2, they can be easily and securely connected with the main circuit board 12 and the players 14, 16, 18. Specifically, according to this construction, the connecting operation for the cables 15, 17, 19 can be split: after one connector C22 of the cable 15, 17 or 19 is connected, the other connector C22 thereof is connected. Thus, an operation force necessary for one connecting operation of the connector C22 can be reduced. Therefore, even in the case that the cables 15, 17, 19 have quite a number of conductors 2, they can be easily and securely connected by splitting the connecting operation.

Further, in this audio unit, the connector C22 is provided with the lock piece 54 serving also as the handle and can be more easily handled by using this locking piece as described above. Thus, the connector C22 can be inserted into and detached from the connector C14 while being more securely gripped. Therefore, operability in connecting or detaching the cable 15, etc. with or from the main circuit board 12 can be improved. Particularly, after the respective players 14, 16, 18 are mounted inside an instrument panel, a work space is considerably restricted, making it difficult to insert and detach the connector C22 for repair, inspection, etc. However, by providing the connector C22 with the lock piece 54 as described above, the connector C22 can be smoothly and quickly inserted and detached even in a narrow space.

If the lock piece 54 is locked at the closing position except during the operation of inserting or detaching the connector C22, space taken up by the connector C22 is small. Thus, the connector C22 does not hinder other operations. It may be considered to, for example, fixedly provide a projection or the like as a grip at part of the connector. However, the inventive construction is more rational than such a construction.

Figure 15A:
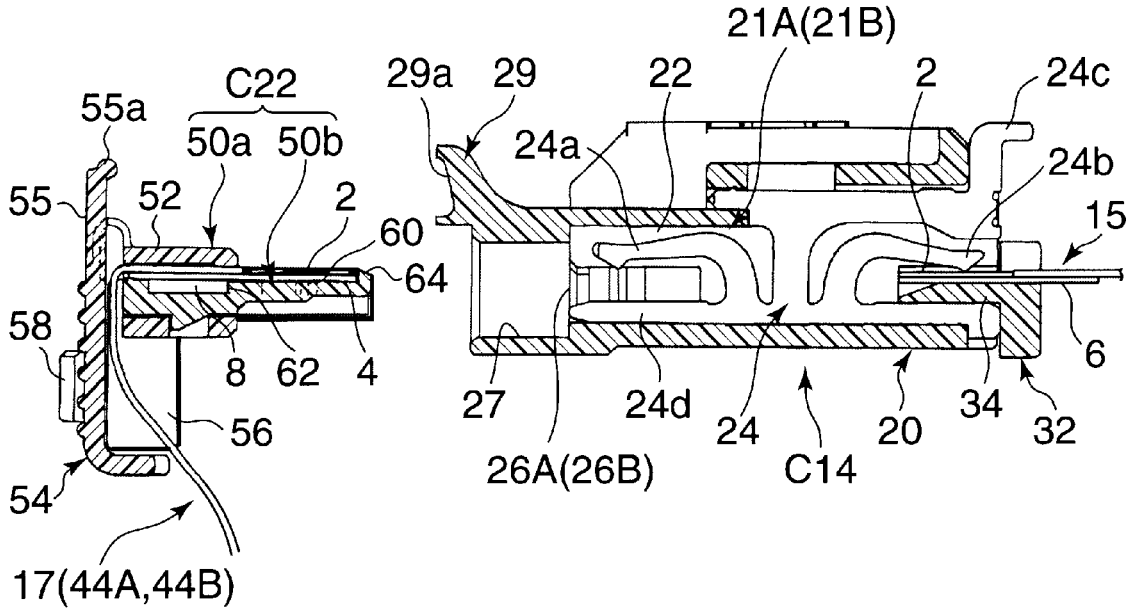
FIGS. 15A and 15B are sectional views showing a construction of the connector assembly according to the modification of the first embodiment prior to and after connection of the two connectors, respectively.

As a modification, the connector C22 and the connector C14 (C12, C16, C18) may take such a construction provided with a disengaging mechanism for disconnecting the connector C22 from the connector C14 (C12, C16, C18) as the lock piece 54 is unlocked as shown in FIG. 15A. Hereinafter, this modification is specifically described.

Figure 14A:
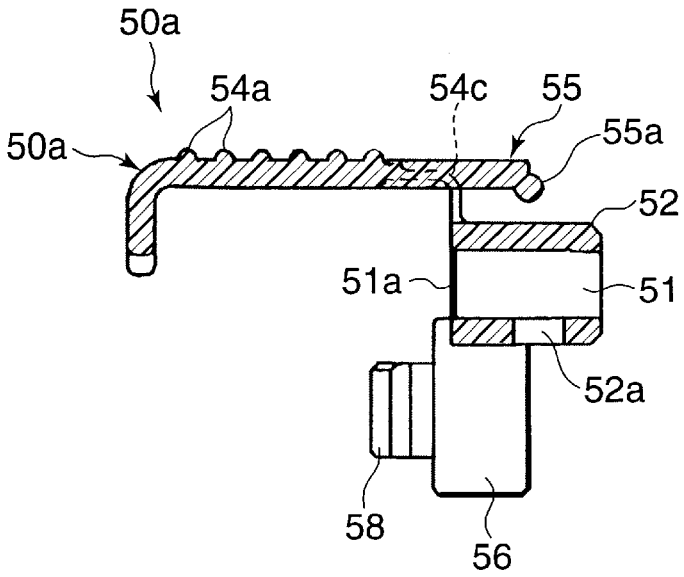
FIG. 14A is a sectional view along the line 14A—14A in FIG. 14B.
Figure 14B:
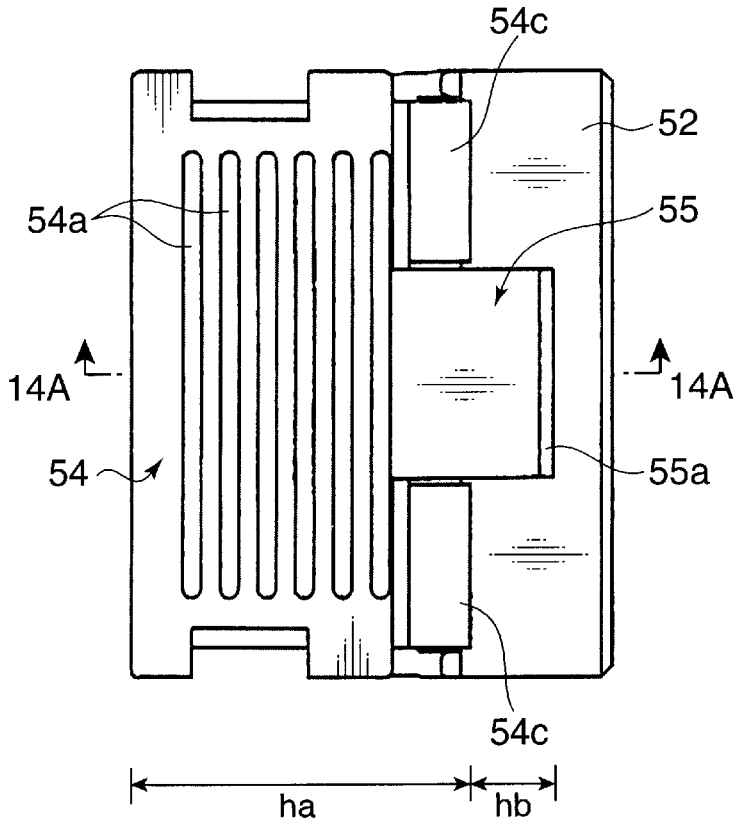
FIG. 14B is a plan view showing a housing of a wire-side connector according to a modification of the first embodiment.

In a connector C22 shown in FIG. 15A is used a housing 50*a* as shown in FIGS. 14A and 14B. In this housing 50*a*, a center portion (widthwise center portion) at the base end of the lock piece 54 is not coupled to a shell portion 52, and a plate-shaped cam member 55 (cam) extends from this center portion. This cam member 55 extends in a direction opposite from a main portion (portion more leftward than a pivotal point in FIG. 14A) of the lock piece 54 with respect to the pivotal point (i.e., portion coupled to the shell portion 52) of the lock piece 54, and a slidable portion 55*a* extending in widthwise direction and having a substantially circular cross section is provided at a distal end thereof.

The housing 50*a* is constructed such that, when the connector C22 is mounted on the split piece 44A(44B) of the cable 17 and the lock piece 54 is locked, the cam member 55 of the lock piece 54 stands straight up atop the connector C22 as shown in FIG. 15A.

As shown in FIG. 14B, dimension "ha" between the pivotal point of the lock piece 54 of the housing 50*a* and a distal end of the main portion is set longer than dimension "hb" between the pivotal point and the slidable portion 55*a* (end of the cam).

On the other hand, in the connector C14, a cam follower 29 is integrally formed at the front side (left side in FIG. 15A) of the housing 20 as shown in FIG. 15A. The cam follower 29 is formed to stand atop the respective hoods 27 of the housing 20, and a slide surface 29*a* which has a curved recess-shaped cross section and on which the slidable portion 55*a* of the cam member 55 can slide is formed on the front surface of the cam follower 29.

Figure 15B:
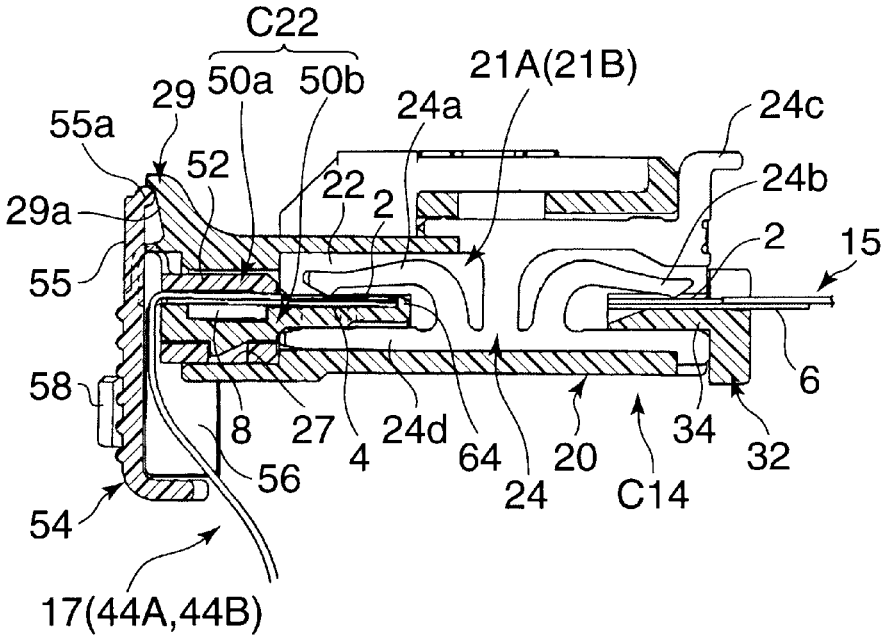
Figure 16A:
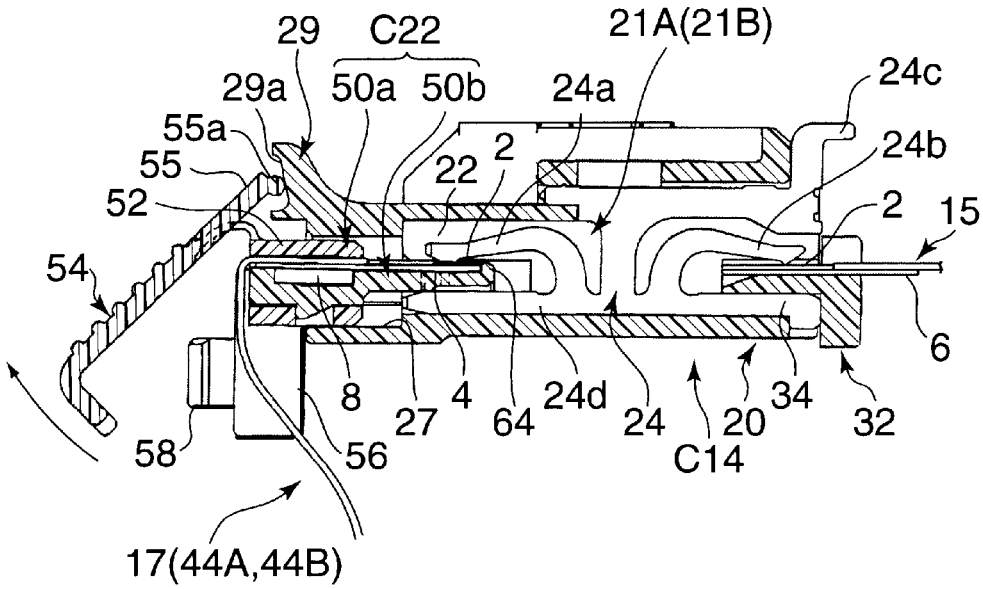
FIGS. 16A and 16B are sectional views showing a construction of the connector assembly according to the modification of the first embodiment when a lock piece starts being unlocked and when the lock piece is completely unlocked, respectively.
Figure 16B:
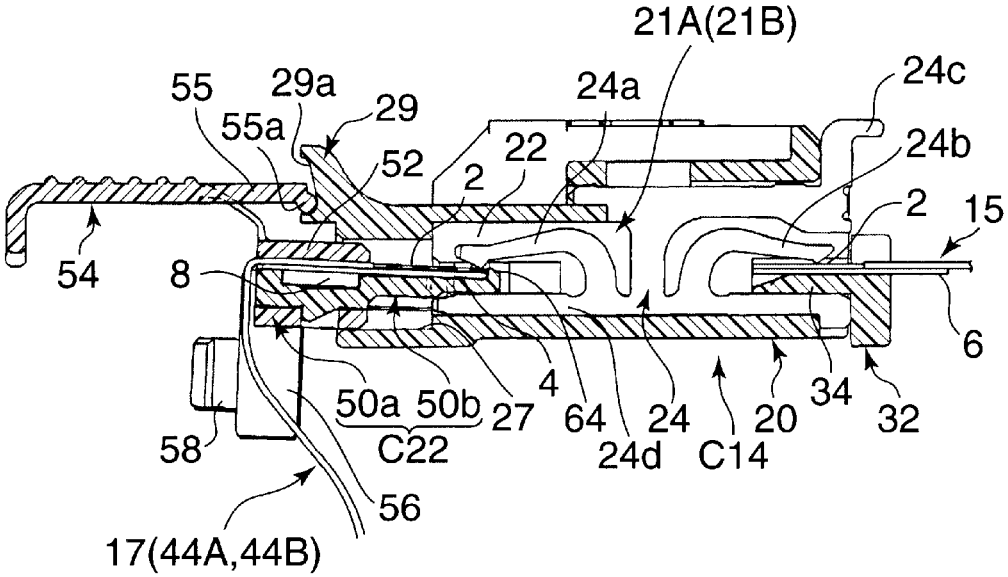

When the connectors C14, C22 of this example are connected, the cam member 55 (slidable portion 55*a*) of the lock piece 54 of the connector C22 is in contact with the cam follower 29 (slide surface 29*a*) of the connector C14 as shown in FIG. 15B. If the lock piece 54 is unlocked to detach the connector C22 in this state, the lock piece 54 is pivotable (rotatable) about a contact portion of the slidable portion 55*a* of the cam member 55 with the slide surface 29*a* of the cam follower 29 as shown in FIG. 16A with the slidable portion 55*a* and the slide surface 29*a* held in contact, and the connector C22 is moved in withdrawing direction (disengaging direction) with respect to the connector C14 as the lock piece 54 is pivoted. When the lock piece 54 is displaced to a substantially horizontal position, a partly connected state where the connector C22 is almost withdrawn from the connector C14 as shown in FIG. 16B is reached.

Specifically, in the connector construction provided with the disengaging mechanism, the connector C can be disconnected from the connector C14 only by unlocking the lock piece 54. Further, since the disengaging mechanism serves as a so-called leverage (incorporated with a power-multiplying mechanism) by setting the dimension "ha" of the lock piece 54 of the housing 50*a* from its pivotal point to the distal end of the main portion longer than the dimension "hb" from the pivotal point to the slidable portion 55*a* as described above, the connector C22 can be disconnected from the connector C14 with a small operation force by the action of this leverage upon unlocking the lock piece 54. Accordingly, there is an effect of improving an operability during the detachment of the cable 17 as compared to the connector construction (construction shown in FIG. 2, etc.) described above.

Next, a second embodiment of the present invention is described.

FIGS. 17 to 19 and 21A show another embodiment of the connectors C12, C14, C16, C18 and C22. The basic constructions of the connectors C12 to C18 and the connector C22 according to the second embodiment are common to those of the first embodiment. Accordingly, no description is given below on the common elements by identifying them by the same reference numerals and differences between the first and second embodiments are described in detail, taking the connector C14 as an example.

In the connector C14 of the second embodiment, the locking pieces 40 as in the first embodiment are not provided in the housing 20 (see FIG. 22A) and, instead, a pair of locking holes 27*a* for locking the connector C22 are formed on the ceiling of the hood 27 corresponding to each insertion opening 26A, 26B. The guide grooves 28 for guiding the connector C22 are not provided in the housing 20, either.

The construction of the connector C22 according to the second embodiment is similar to that of the connector C22 according to the first embodiment in being comprised of the housing 50*a* and the holder 50*b*. However, these two connectors C22 are different in following points.

Specifically, the housing 50*a* of the second embodiment includes a rear plate 70*a*, side plates 70*b* and a ceiling plate

Figure 20:
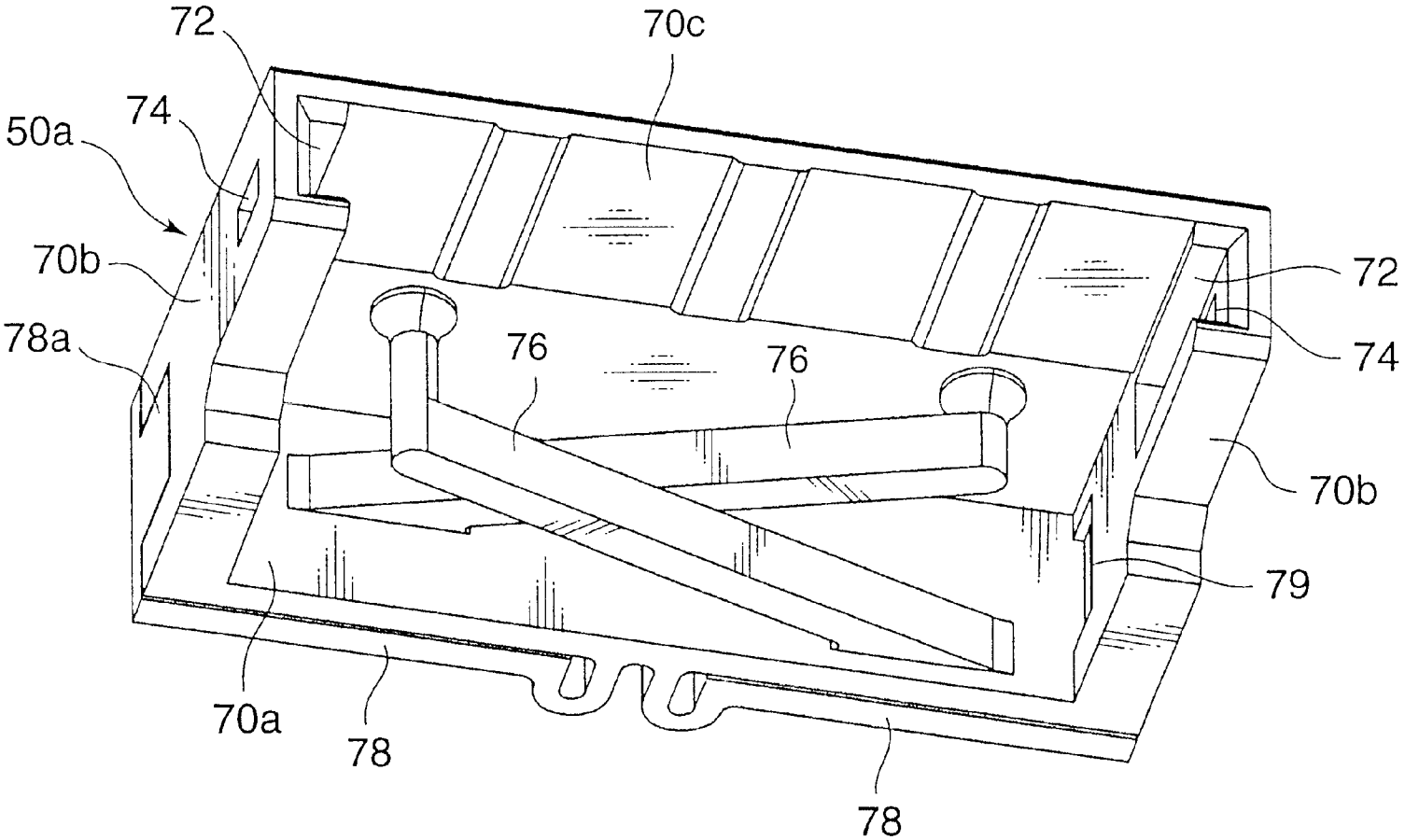
FIG. 20 is a diagram showing a housing of the wire-side connector of the second embodiment.

70*c* and has a substantially L-shaped cross section as shown in FIG. 20. A guiding portion 72 extending in forward and backward directions (transverse direction in FIG. 21A) for guiding the holder 50*b* is formed on the inner wall of each side plate 70*b* of the housing 50*a*, and a locking hole 74 for locking the holder 50*b* is formed in each guiding portion 72.

Further, a pair of pressing bars 76 intersecting with each other and resiliently deformable extend obliquely with respect to widthwise direction from the inner wall surface of the rear plate 70*a*.

Figure 17:
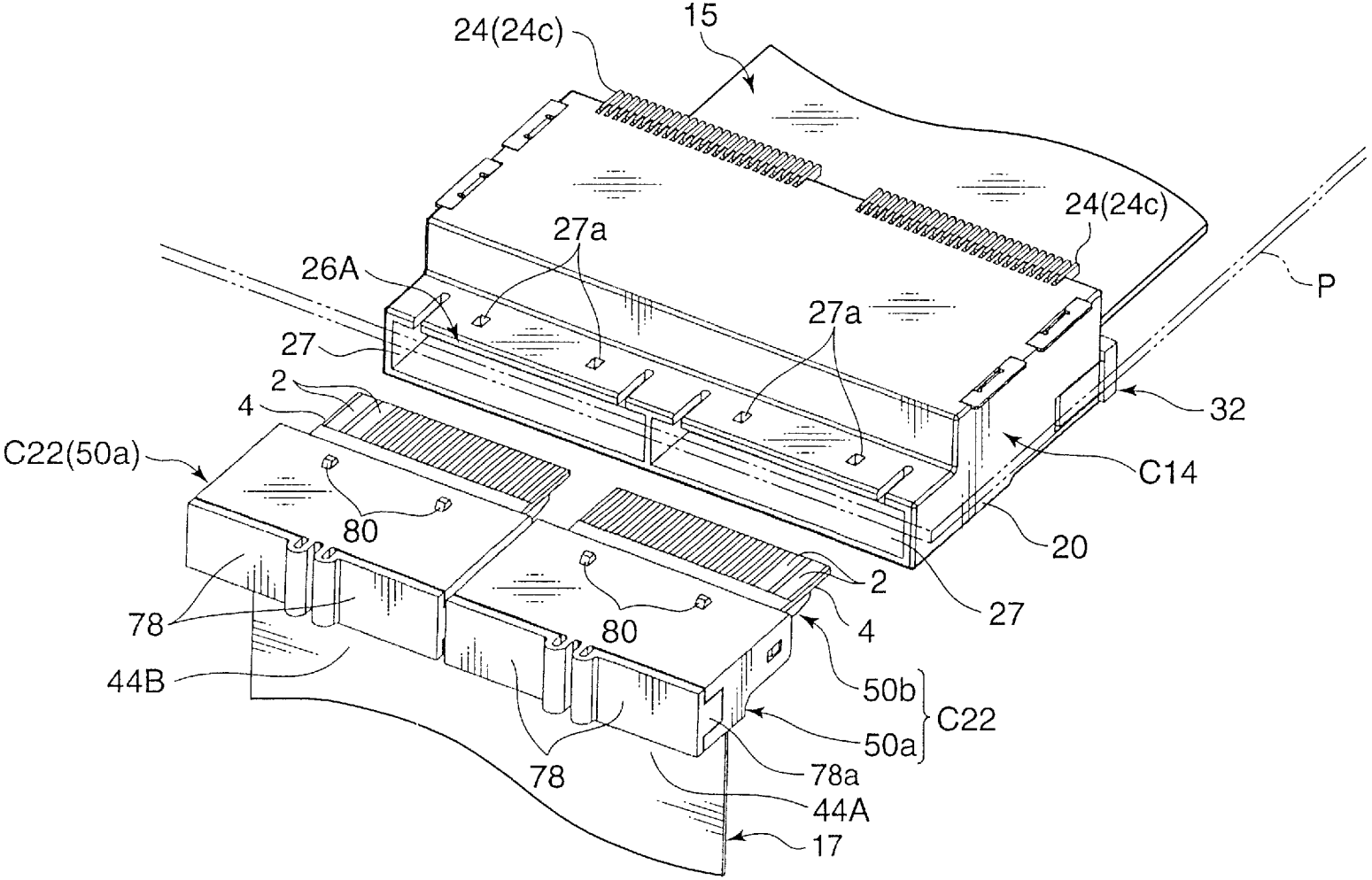
FIG. 17 is a perspective view showing a connector assembly according to a second embodiment of the present invention comprised of a terminal-side connector to be mounted on a circuit board of a CD player and a wire-side connector for a flat cable to be connected with the terminal-side connector.
Figure 18:
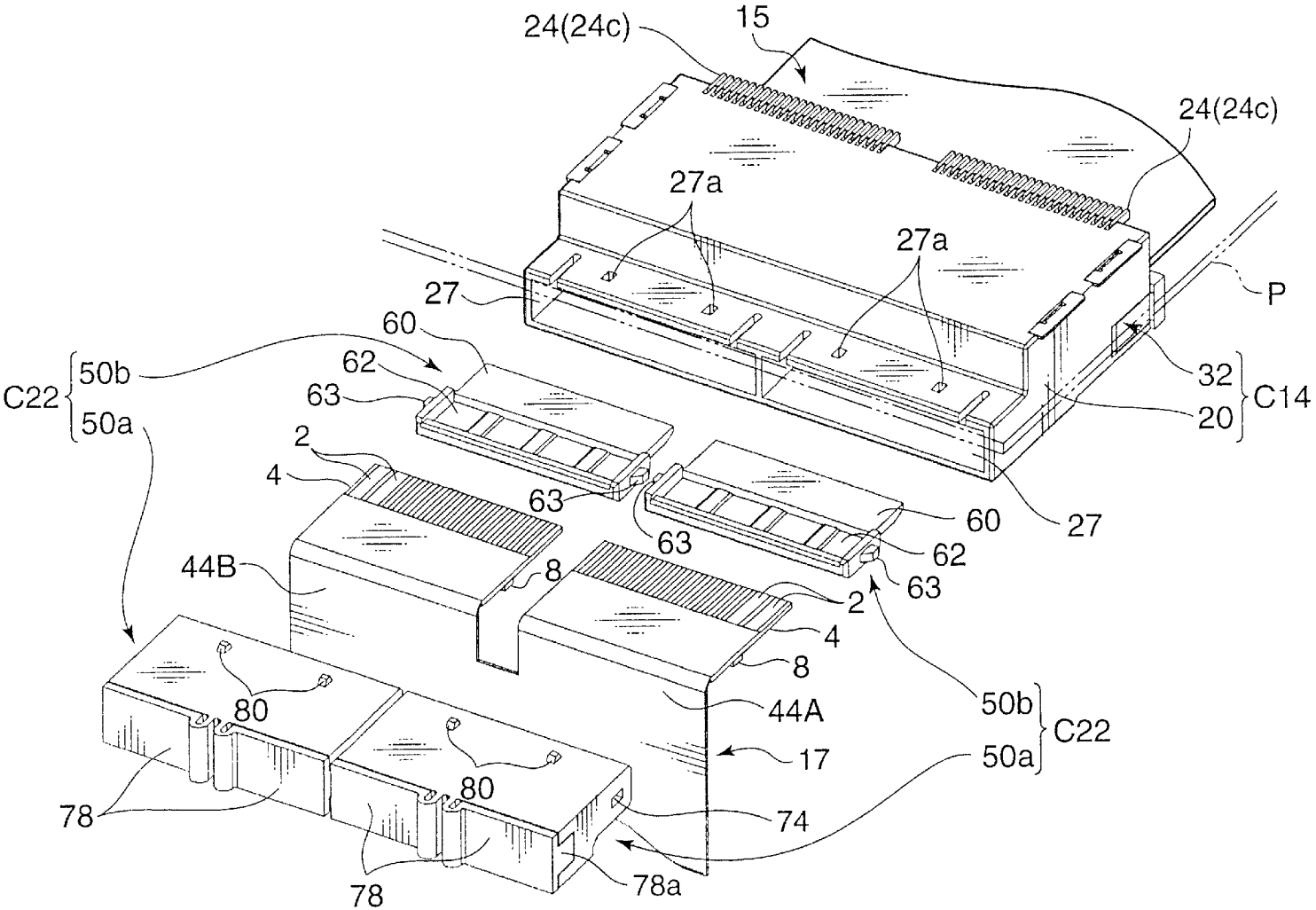
FIG. 18 is an exploded perspective view showing the terminal-side connector and the wire-side connector of the second embodiment.
Figure 19:
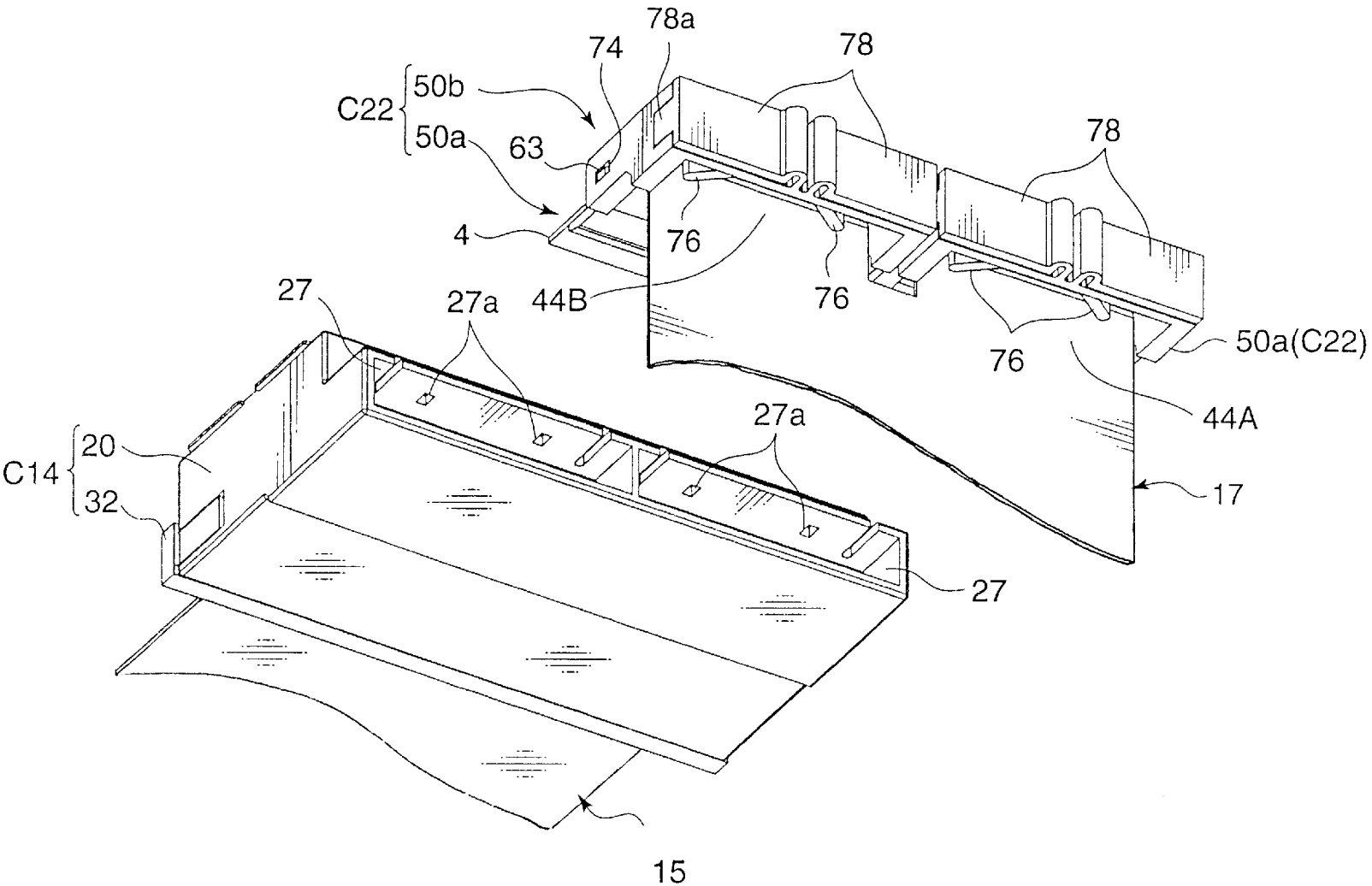
FIG. 19 is a perspective view showing the terminals-side connector and the wire-side connector of the second embodiment when being viewed from below.

A pair of handles 78 in the form of a thin plate are provided on the outer wall surface of the rear plate 70*a* as shown in FIGS. 17 and 18. The handles 78 are secured to the widthwise center of the rear plate 70*a* and are pivotal about their base ends, i.e., fixed ends between an accommodated position (position shown in FIG. 17, etc.) where the handles 78 are laid over the outer wall surface of the rear plate 70*a* and a used position where the handles 78 are upright with respect to the rear plate 70*a* and held back-to-back (see FIG. 23). A hook 78*a* is formed at the leading end of each handle 78. When the handles 78 are set at the accommodated position, the hooks 78*a* are engaged with the side plates 70*b* via the locking holes 79 formed in the side plates 70*b*, with the result that the handles 78 are locked at the accommodated position. In other words, the locking mechanism of the present invention is formed by the locking holes 79, etc.

Protuberances 80 corresponding to the locking holes 27*a* of the connector C14 are formed on the upper surface of the ceiling plate 70*c* of the housing 50*a* as shown in FIG. 18.

On the other hand, the holder 50*b* of the second embodiment is basically identical to that of the first embodiment, but no rib 64 is provided at the leading end of the alignment surface 60. Further, instead of the hooks 68 on the bottom surface of the holder 50*b*, hooks 63 are provided on the outer side surfaces of the holder 50*b* as shown in FIG. 18.

Figure 21A:
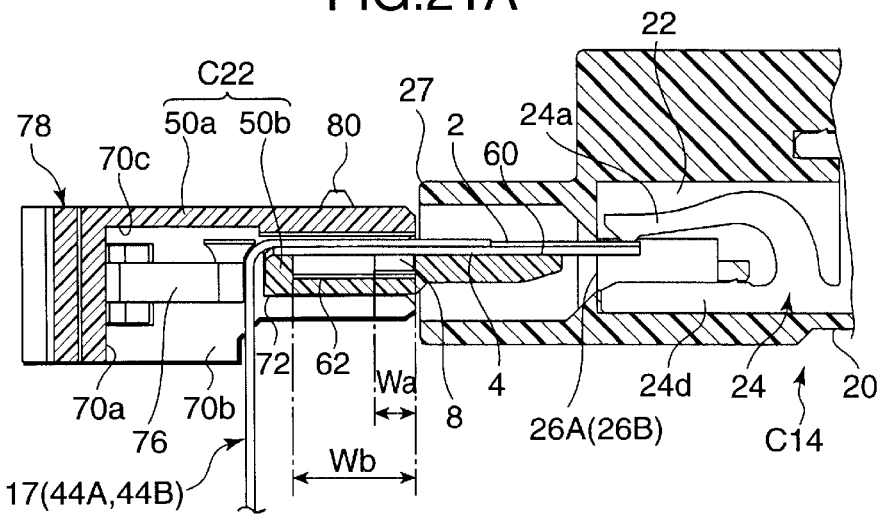
FIGS. 21A, 21B and 21C are sectional views showing constructions of the terminal-side and wire-side connectors of the second embodiment prior to, at an intermediate stage of and after connection of the two connectors, respectively.

In the second embodiment, as shown in FIG. 21A, a dimension "Wa" of the positioning plate 8 of the cable 17 in forward and backward directions is set shorter than a dimension "Wb" of the recess 62 of the holder 50*b* in forward and backward directions, so that the split piece 44A(44B) is relatively slidable with respect to the holder 50*b* in forward and backward directions while being placed on the holder 50*b*. Further, a dimension of the reinforcing plate 4 in forward and backward directions is set and the positioning plate 8 is positioned in forward and backward directions with respect to the split piece 44A(44B) such that the leading end of the split piece 44A(44B) projects forward (rightward in FIG. 21A) from the alignment surface 60 when the front end surface of the positioning plate 8 is in contact with the front end wall of the recess 62 as shown in FIG. 21A.

The connector C22 is mounted on the split piece 44A (44B) as follows. The holder 50*b* is placed under the split piece 44A(44B) via the alignment surface 60 and, in this state, the split piece 44A(44B) is inserted together with the holder 50*b* into the housing 50*a* along the guiding portions 72 from its rear end. The hooks 63 at the sides of the holder 50*b* are engaged with the locking holes 74 to lock the holder 50*b* and the housing 50*a* into each other. As a result, each connector C22 is mounted on the split piece 44A(44B).

When the connector C22 is thus mounted on the split piece 44A(44B), the exposed sections of the conductors 22 at an end of the split 44A(44B) are supported together with the holder 50*b* while projecting forward from the front end of the housing 50*a* as shown in FIG. 21A. Further, the leading end of the split piece 44A(44B) is pressed forward from behind the reinforcing plate 4 by the pressing bars 76 and the front end surface of the positioning plate 8 is held in contact with the front end wall of the recess 62, with the result that the leading end of the split piece 44A(44B) is held while projecting from the leading end of the holder 50*b*.

The cable 17 is connected with the connector C14 constructed as described above as follows. First, the connector C22 is placed to face the insertion opening 26A(26B) of the connector C14, and the connector C22 is inserted into the insertion opening 26A(26B) from the leading end of the holder 50*b* as shown in FIG. 21B.

Figure 21B:
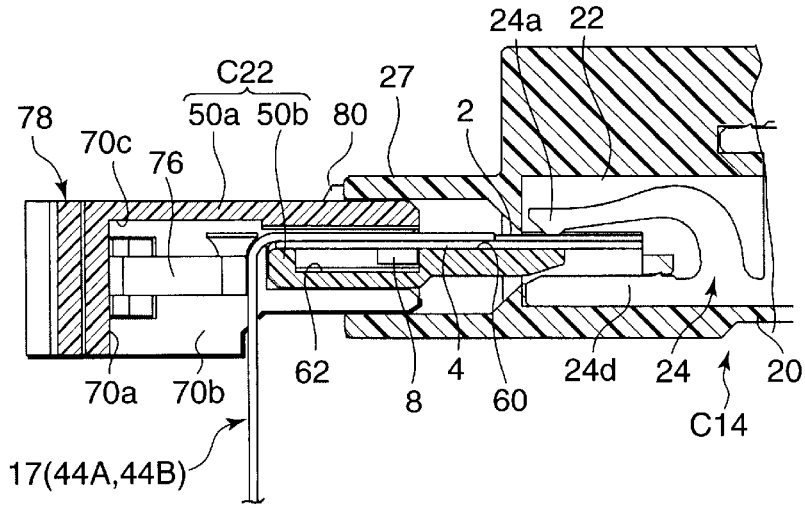
Figure 21C:
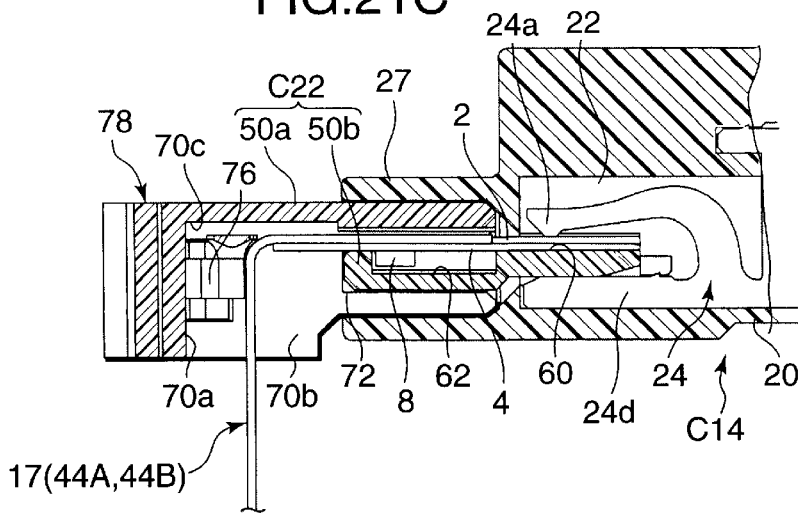
Figure 22A:
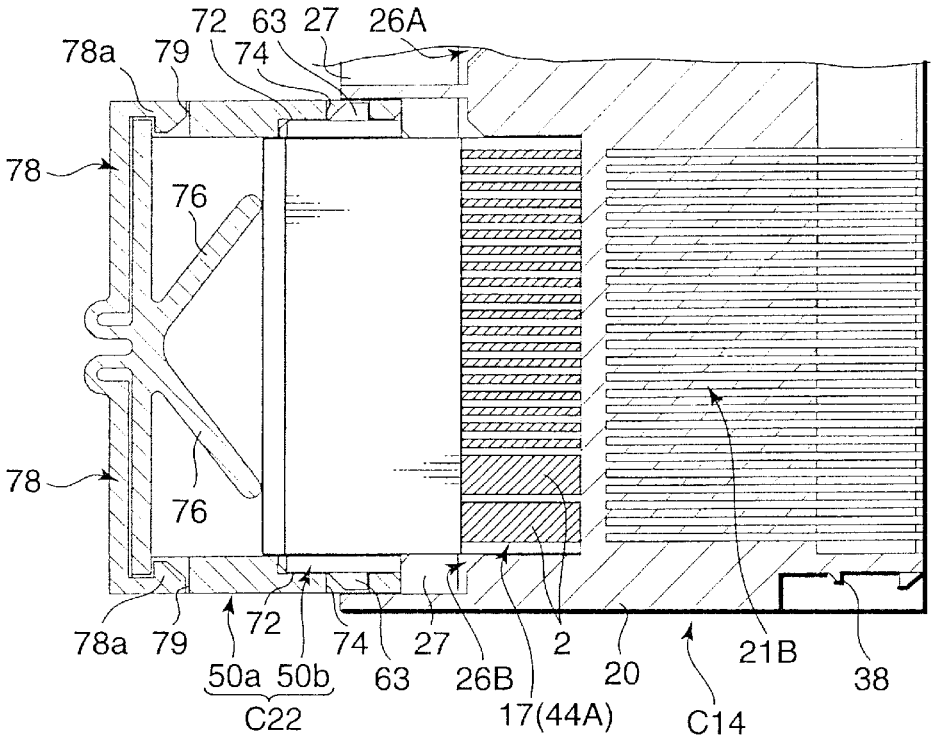
FIGS. 22A and 22B are sectional views showing constructions of the terminal-side and wire-side connectors of the second embodiment at an intermediate stage of and after connection of the two connectors, respectively.
Figure 22B:
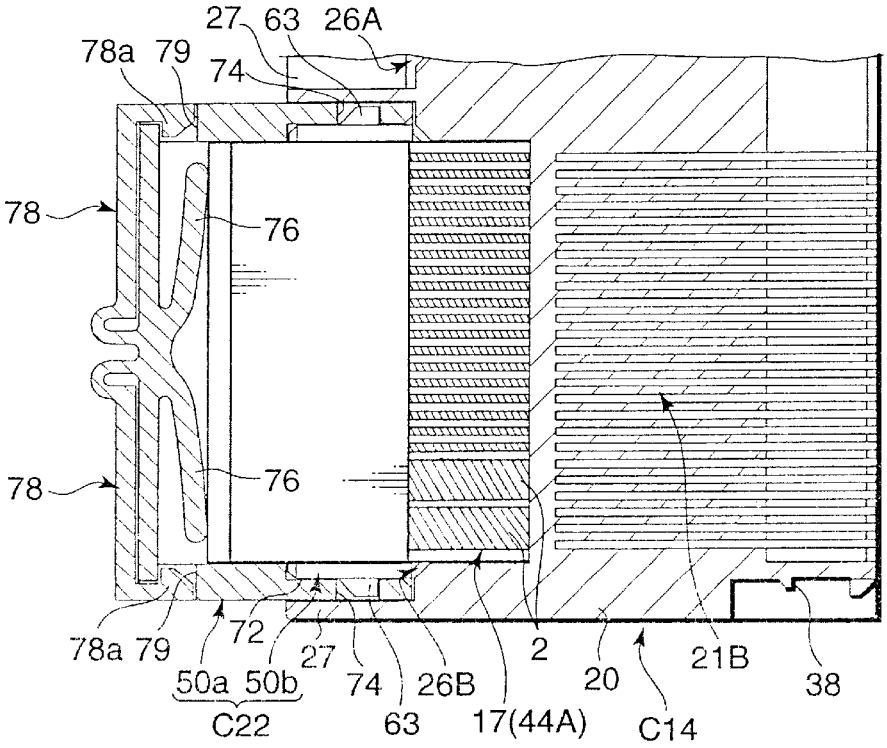

Then, as shown in FIGS. 21B and 22A, the housing 50*a* of the connector C22 starts entering the hood 27 of the connector C14 and the leading end of the split piece 44A (44B) comes into contact with the back end of an insertable range in the connector C14. When the connector C22 is further inserted, the housing 50*a* and the holder 50*b* are moved with respect to the split piece 44A(44B). When the connector 22 is further inserted until the leading end of the holder 50*b* comes into contact with the back end of the insertable range in the connector C14 as shown in FIGS. 21C and 22B, the front end of the housing 50*b* is completely engaged with the hood 27 and the protuberances 80 are engaged with the locking holes 27*a* of the hood 27. In this way, the connector C22 is locked into the connector C14. Each protuberance 80*a* of the holder 50*b* is tapered from its base end toward its leading end, thereby being substantially trapezoidal in side view (see FIG. 21A). Accordingly, this locked state is a so-called "semi-locked" state and, when being pulled in a withdrawing direction with a specified force or larger, the connector C22 can be detached from the connector C14 while being unlocked.

When the connectors C22 are thus connected with the connector C14, the exposed sections of the conductors 2 of the cable 17 are inserted into the connection sections 21A, 21B of the connector C14 together with the holder 50*b*, thereby being brought into contact with the deformable pieces 24*a* of the respective terminals 24. Further, as shown in FIGS. 21C and 22B, the split pieces 44A, 44B are pushed back with respect to the holder 50*b*, thereby resiliently deforming the respective pressing bars 76. The leading ends of the split pieces 44A, 44B are biased toward the back ends of the insertable ranges in the connector C14 by the resilient restoring forces of the pressing bars 76. Therefore, the split pieces 44A, 44*b* are held in the connector C14 with the leading ends thereof securely held in contact with the back ends of the insertable ranges in the connector C14.

Figure 23:
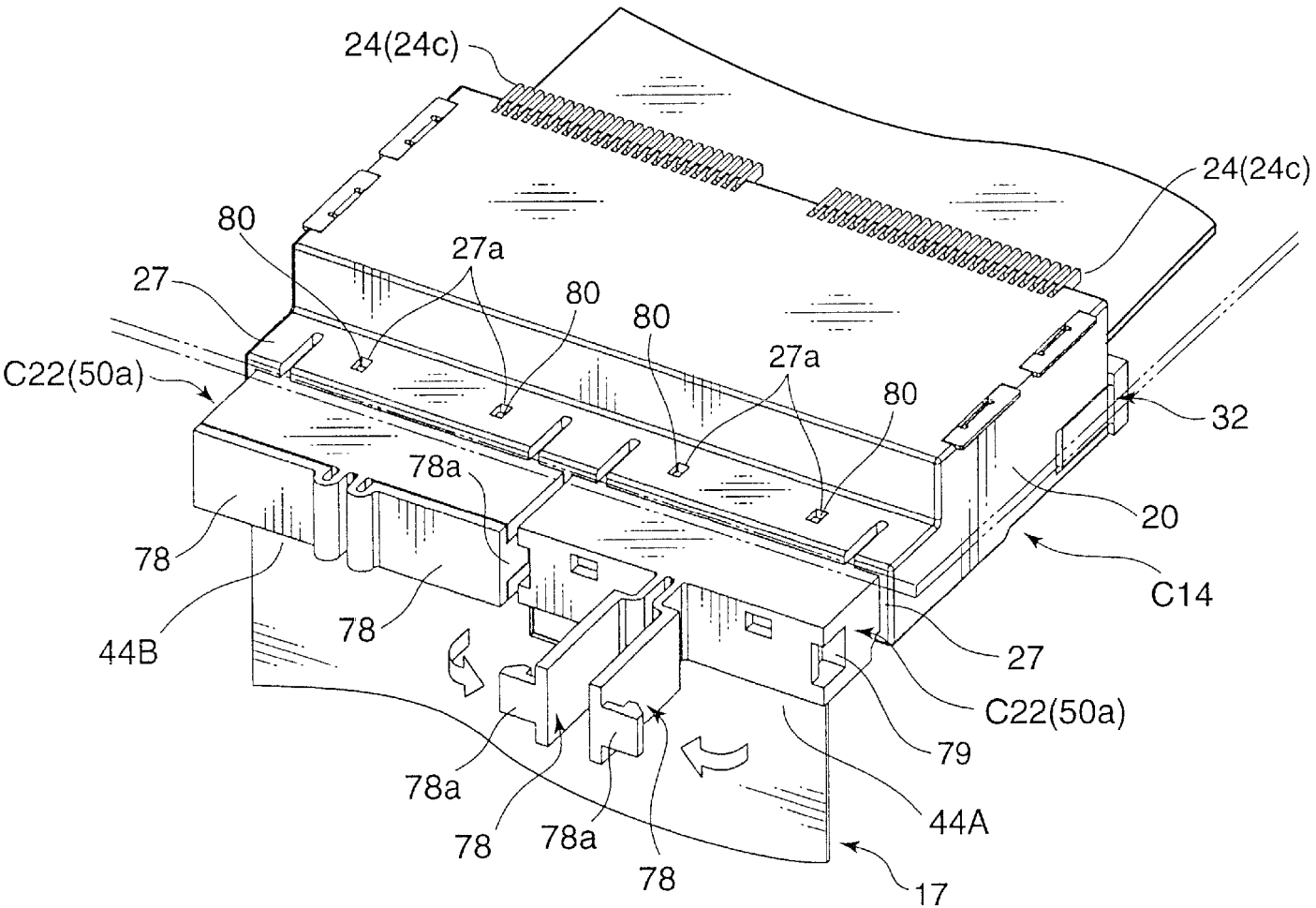
FIG. 23 is a perspective view showing a connected state of the terminal-side connector and the wire-side connector of the second embodiment.

The connectors according to the second embodiment can also easily and securely connected with each other since the connectors C22 are provided with the handles 78 as described above. Specifically, the respective handles 78 of each connector C22 are unlocked and placed back-to-back as shown in FIG. 23, and the connector C22 is connected with the connector C14 by gripping the handles with fingertips or using pliers or the like. Thus, even if the connectors C22 are small or connected in a narrow work space, they are easy to grip, enabling the cable 17 to be easily and securely connected. Not only the connecting operation, but also an operation of detaching the cable 17 from the connector C14 at the time of a repair or inspection can also be easily and securely performed.

Accordingly, similar to the first embodiment, the connector assembly for flat wire member (i.e., connector C14 and connectors C22) according to the second embodiment has also an effect of an improved operability in connecting and detaching the cable 15, etc. with and from the main circuit board 12, etc. Further, since the handles 78 can be locked at the accommodated positions also in the second embodiment as described above, they do not hinder other operations as in the first embodiment by being locked at the accommodated positions except during the operation of inserting or detaching the connectors C22.

The second embodiment is more advantageous than the first embodiment in terms of the strength of the handles 78 since the connector C22 is provided with a pair of handles 78, which are simultaneously gripped by being held back-to-back.

Next, a third embodiment of the present invention is described.

Figure 24:
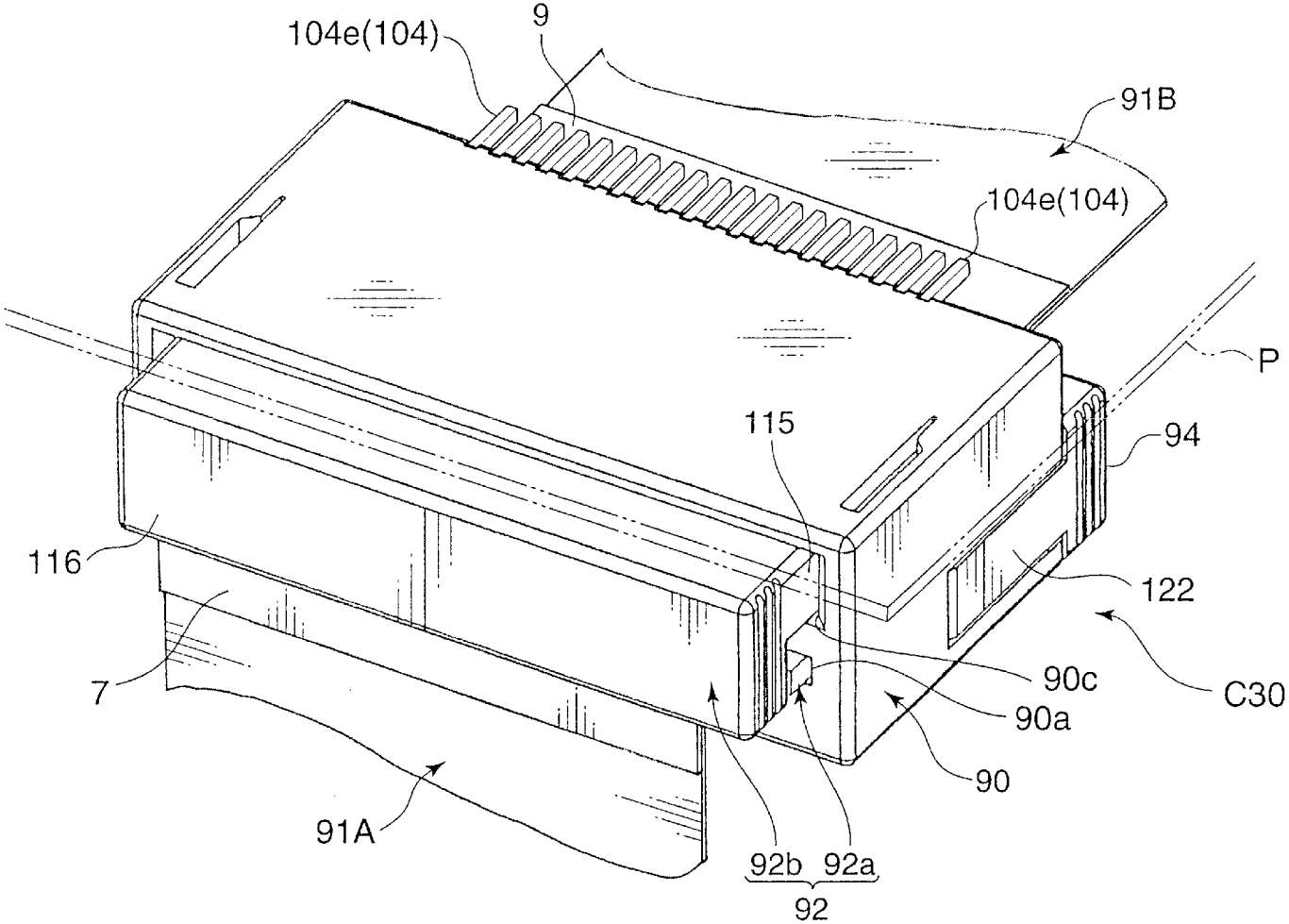
FIG. 24 is a perspective view showing a connector assembly for flat wire member according to a third embodiment of the invention.
Figure 25:
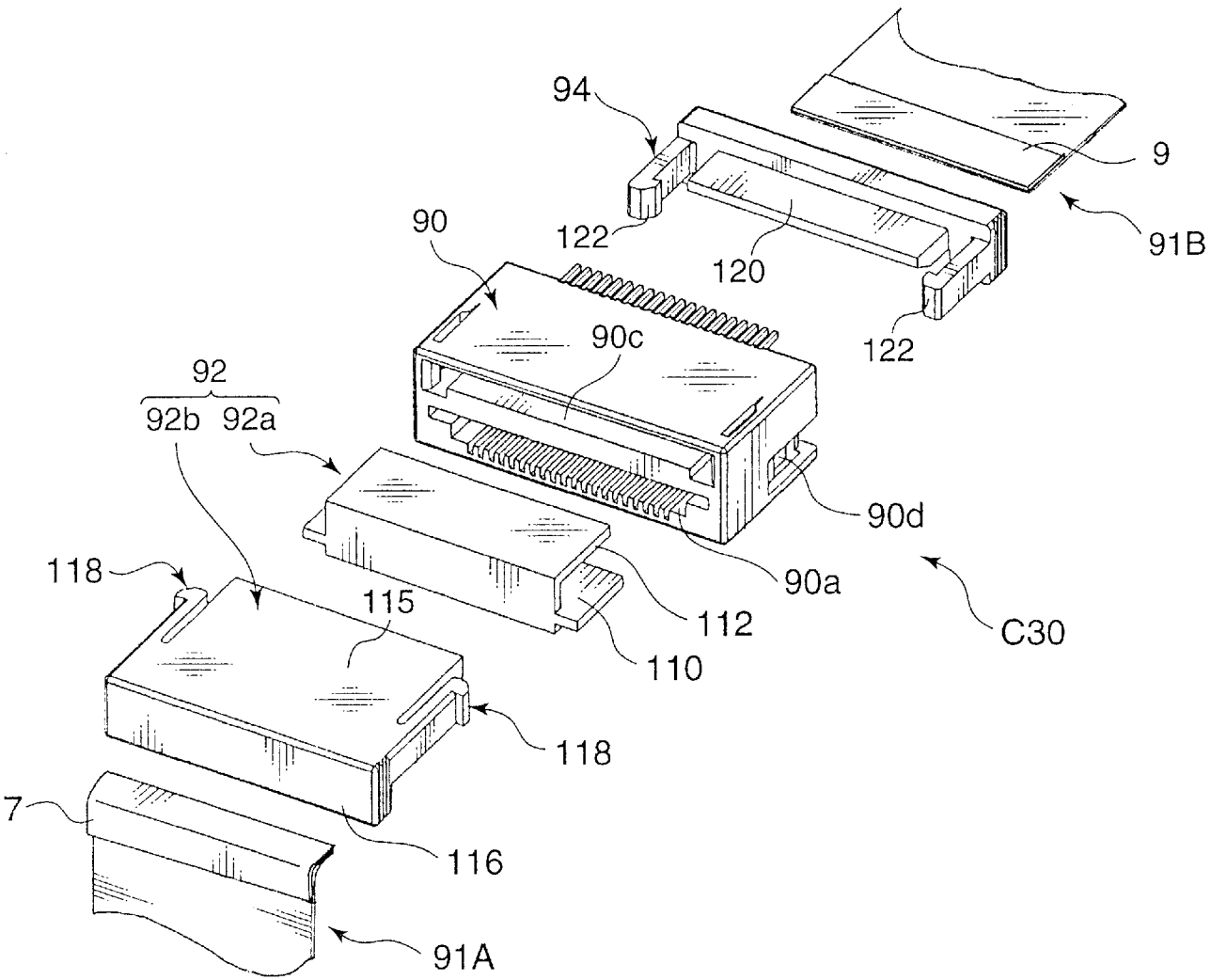
FIG. 25 is an exploded perspective view showing the connector of the third embodiment.
Figure 26A:
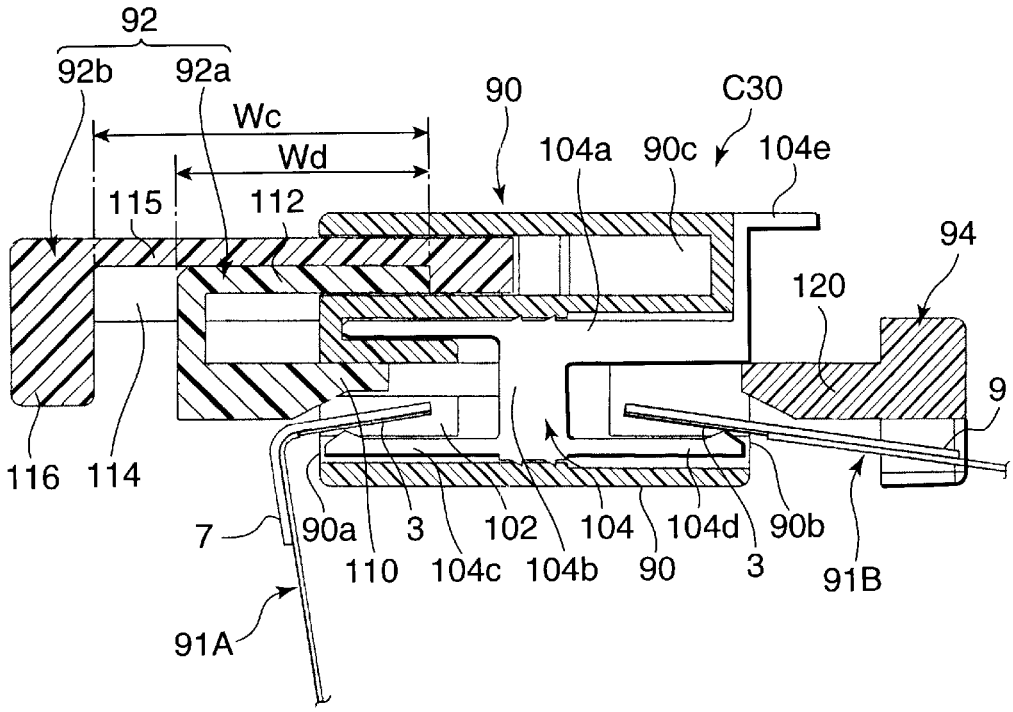
FIGS. 26A and 26B are sectional views showing the connector assembly of the third embodiment prior to and after connection of the flat wire member.

FIGS. 24, 25 and 26A show a connector assembly for flat wire member according to the third embodiment. The third embodiment is independent of the audio units of the first and second embodiments.

A connector C30 for flat wire member (hereinafter, merely "connector C30") shown in these FIGURES is a connector for circuit board to be mounted on the lower surface of a circuit board P and is so constructed as to electrically connect two identically constructed (having the same number of conductors arrayed at the same intervals) flat cables 91A, 91B (hereinafter, merely "cables 91A, 91B") with the circuit board P and to connect corresponding pairs of the conductors of the respective cables 91A, 91B via terminals.

As shown in these FIGURES, the connector C30 includes a long and narrow housing 90, and a multitude of terminal cavities 102 arrayed in longitudinal direction are formed inside the housing 90 and have terminals 104 accommodated therein. Each terminal 104 includes, as shown in FIG. 26A, a base portion 104*a* extending in forward and backward directions along the ceiling of the cavity 102, a trunk portion 104*b* extending downward from a middle position of the base portion 104*a*, deformable pieces 104*c*, 104 for connection extending forward and backward at the bottom end of the trunk portion 104*b*, and a leg portion 104*e* extending upward from the rear end of the base portion 104*a* to the outside of the housing 90. The respective terminals 104 are electrically connected with circuits on the circuit board P by having the leg portions 104*e* thereof soldered to a fixing land (not shown) or the like on the circuit board P.

Insertion openings 90*a*, 90*b* are formed at the front and rear sides (left and right sides in FIG. 26A) of the housing 90, and a first and a second sliders 92, 94 are insertable into these insertion openings 90*a*, 90*b*. Further, a hollow guiding portion 90*c* for guiding the first slider 92 is formed above the front insertion opening 90*a*.

The first slider 92 (fixture device) is comprised of a slider main body 92*a* and a holder 92*b*.

The slider main body 92*a* is a member having a U-shaped cross section and including a plate-shaped tongue 110 extending in the longitudinal direction of the insertion opening 90*a* and a guide plate 112 arranged below and parallel with the tongue 110 as shown in FIGS. 25 and 26A. The tongue 110 is inserted into the insertion opening 90*a* and the guide plate 112 is inserted together with the holder 92*b* into the guiding portion 90*c*.

The holder 92*b* is a member having an L-shaped cross section and including a plate-shaped insertable portion 115 and a handle 116 extending downward from the rear end (left end in FIG. 26A) of the insertable portion 115. The holder 92*b* is inserted into the guiding portion 90*c* of the housing 90 with the insertable portion 115 placed on the guide plate 122.

A recess 114 whose rear wall is formed by the handle 116 is formed in the lower surface of the insertable portion 115, and the guide plate 112 is placed on the holder 92*b* while being fitted in the recess 114. A dimension "Wc" of the recess 114 in forward and backward directions is set larger than a dimension "Wd" of the guide plate in forward and backward directions so as to permit a movement (sliding displacement) of the guide plate 112 in forward and backward directions (transverse direction in FIG. 26A) within a specified range while restricting a widthwise movement of the guide plate 112. Further, as shown in FIG. 25, a hook 118 facing outward is provided on the widthwise outer side of each insertable portion 115. When the insertable portion 115 is inserted into the guiding portion 90*c*, these hooks 118 are engaged with engaging portions formed in the guiding portion 90*c* to lock the holder 92*b* into the housing 90. Each engaging portion in the guiding portion 90*c* is, for example, tapered from its base end toward its leading end, thereby being substantially trapezoidal in side view. Accordingly, this locked state is a so-called "semi-locked" state and, when being pulled in a withdrawing direction with a specified force or larger, the holder 92*b* can be detached from the housing 90 while being unlocked.

On the other hand, the second slider 94 includes a plate-shaped tongue 120 extending in the longitudinal direction of the housing 90 and insertable into the insertion opening 90*b*. Hooks 122 are provided at the opposite shorter sides of the second slider 94. When the second slider 94 is inserted into the housing 90, these hooks 122 are engaged with locking portions 90*d* formed in the side surfaces of the housing 90 to lock the second slider 94 into the housing 90.

The ends of the respective cables 91A, 91B are processed to expose conductors 3, and reinforcing plates 7, 9 in the form of a thin plate are mounted on the upper surfaces thereof as shown in FIGS. 25 and 26A.

In the construction as described above, the cable 91A is connected with the connector C30 as follows. First, as shown in FIG. 26A, the end of the cable 91A is loosely inserted into the housing 90 through the front insertion opening 90*a* until coming into contact with the back end of an insertable range in the housing 90. In this state, the first slider 92 is inserted into the housing 90 from front. Specifically, as shown in FIG. 26A, the holder 92*b* is placed on the slider main body 92*a* with the guide plate 112 fitted in the recess 114 of the insertable portion 115 from below and, in this state, the tongue 110 of the slider main body 92*a* is inserted into the insertion opening 90*a* and the guide plate 112 of the slider main body 92*a* is inserted together with the holder 92*b* into the guiding portion 90*c*. At this time, the handle 116 of the holder 92*b* is pushed from behind.

Figure 26B:
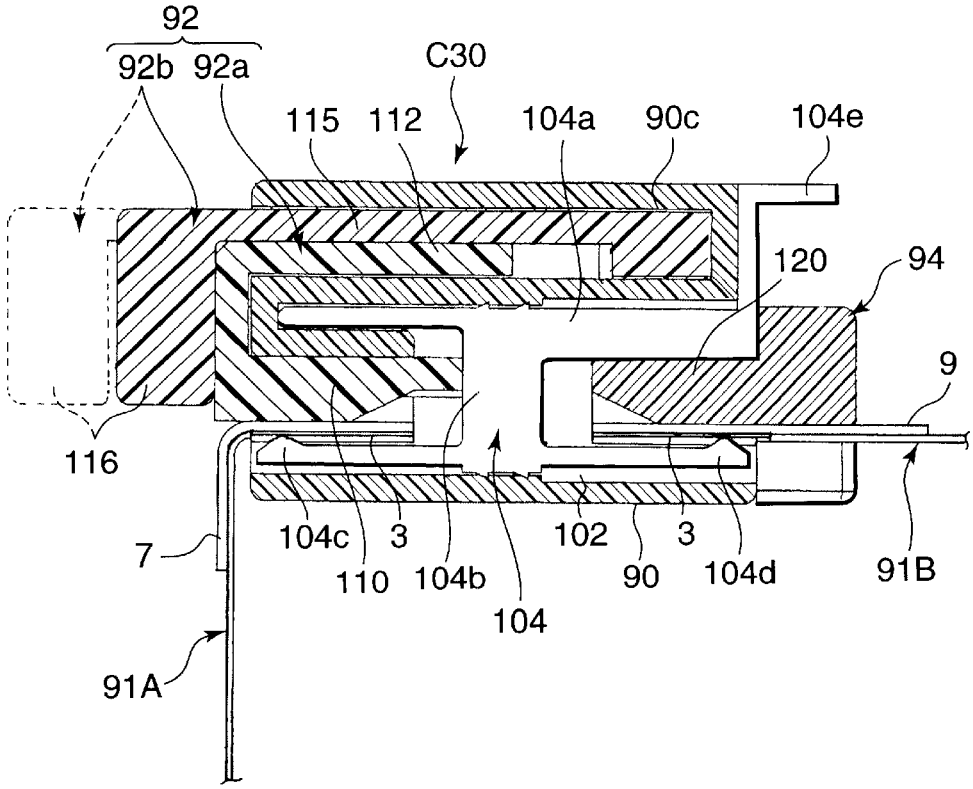

If the slider main body 92*a* is inserted in this way until the leading end of the tongue 110 comes into contact with the back end of the insertable range in the housing 90, the hooks 118 of the holder 92*b* are engaged with the engaging portions in the housing 90 to lock the second slider 94 into the housing 90, and the ends of the conductors 3 of the cable 91A are pushed down by the tongue 110 of the slider main body 92*a* as shown in FIG. 26B, with the result that the respective conductors 3 are held in contact with the deformable pieces 104*c* of the terminals 104.

On the other hand, the cable 91B is connected with the connector C30 as follows. As shown in FIG. 26A, the end of the cable 91B is loosely inserted into the housing 90 through the rear insertion opening 90*b* until coming into contact with the back end of the insertable range in the housing 90. Then, the second slider 94 is inserted into the housing 90 with the tongue 120 placed on the cable 91B.

Upon completion of the insertion of the second slider 94, the leading end of the tongue 120 is in contact with the back end of the insertion range in the housing 90 and the hooks 122 are engaged with the locking portions 90*d* to lock the second slider 94 into the housing 90. Then, the end of the cable 91B is pushed down by the tongue 120, thereby bringing the respective conductors 3 into contact with the deformable pieces 104*d* of the terminals 104.

By bringing the respective conductors 3 of the cable 91A and the respective conductors 3 of the cable 91B into contact with the terminals 104 in this way, the conductors 3 of the respective cables 91A, 91B are connected with the circuits on the circuit board P via the terminals 3 and the corresponding pairs of the conductors 3 of the respective cables 91A, 91B are connected via the terminals 104.

In the connector C30 according to the third embodiment as well, the cable 91A connected at the front side of the connector C30 can be easily and securely detached since the first slider 92 is constructed as described above. Specifically, upon detaching the cable 91A, if the handle 116 is gripped and pulled backward, only the holder 92*b* can be easily withdrawn backward from the housing 90 by a difference between the dimension "Wc" of the recess 114 and the dimension "Wd" of the guide plate 112 (Wc>Wd) described above (state shown by chained line in FIG. 26B: used position). Thus, even if the connector C30 is, for example, small or used in a narrow work space, the first slider 92 can be easily gripped by utilizing the withdrawn holder 92*b*, thereby enabling the cable 91A to be easily and securely detached.

Accordingly, similar to the connector assemblies of the first and second embodiments, the connector assembly for flat wire member (connector C30) of the third embodiment has an effect of improving an operability in detaching the cable 91A.

In the connector C30 of the third embodiment as well, if the slider main body 92*a* is locked at a position where it is pushed into the housing 90 as shown by solid line in FIG. 26B (position where the handle 116 is pressed against the housing 90: accommodated position) except during the operation of detaching the cable 91A, the handle 116 does not hinder other operations by taking up a small space.

Next, a fourth embodiment of the present invention is described.

FIGS. 27 to 29 and 30A show a connector assembly for flat wire member according to the fourth embodiment.

The connector assembly shown in these FIGURES is comprised of a wire-side connector C42 to be mounted on an end of flat cable 130 (hereinafter, "cable 130") and a connector C44 for circuit board (terminal-side connector) to be mounted on a circuit board (not shown). The basic constructions of these connectors C42, C44 are common to those of the connectors C22 and C14 of the first embodiment (connectors provided with the disengaging mechanism) shown in FIG. 15. Particularly, the wire-side connector C42 has substantially the same construction as the connector C22 shown in FIG. 15. Thus, no description is given on elements of the wire-side connector C42 common to those of the connector C22 of the first embodiment by identifying them by the same reference numerals, and only differences are described in detail below.

Figure 28:
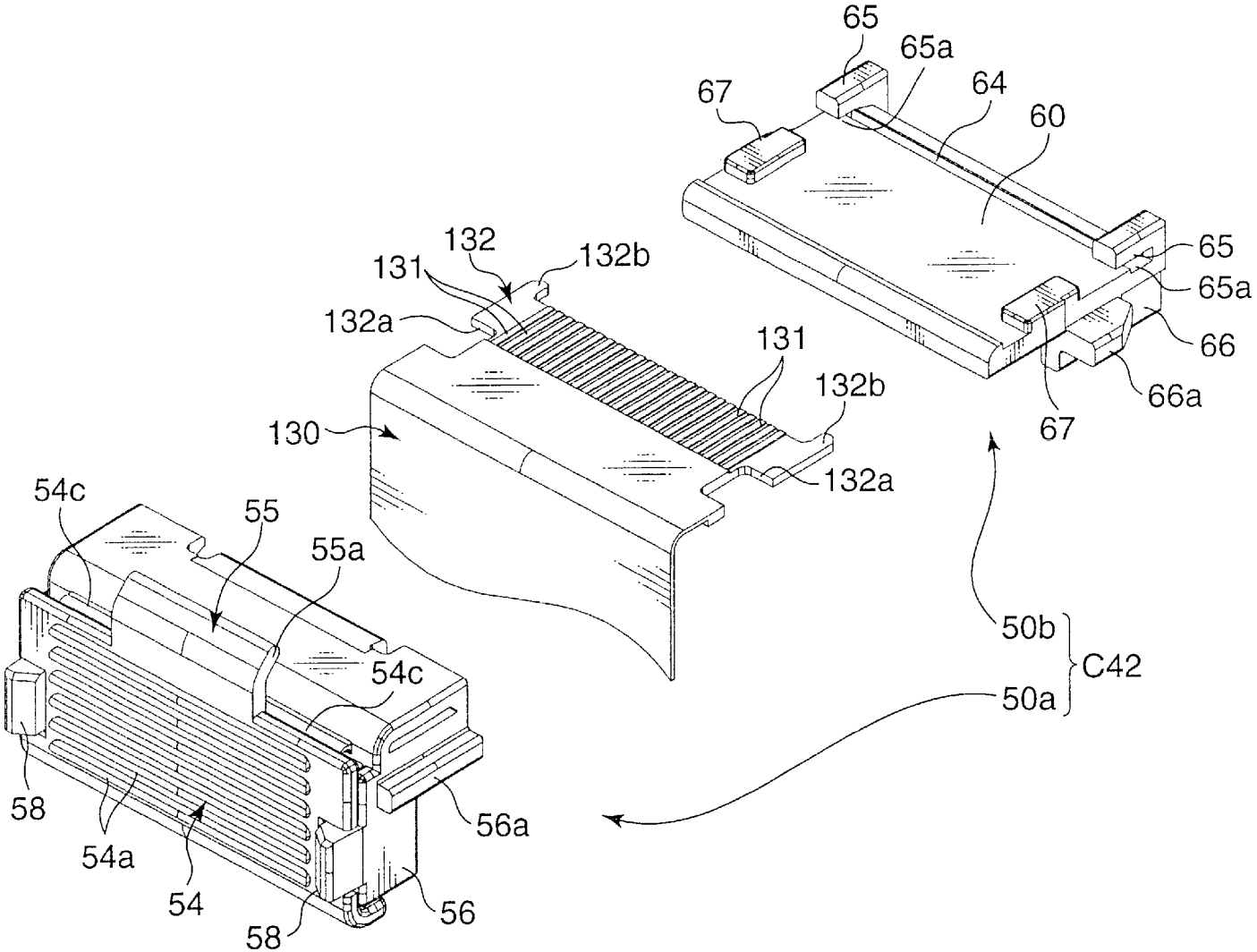
FIG. 28 is an exploded perspective view showing a wire-side connector of the fourth embodiment.

The wire-side connector C42 (hereinafter, "connector C42") is comprised of a housing 50*a* and a holder 50*b* as shown in FIG. 28, and is similar to the connector C22 of the first embodiment in construction in that the connector C42 is mounted on an end of the cable 130 by placing the cable 130 on the holder 50*b* and inserting the cable 130 and the holder 50*b* into the housing 50*a*. However, the fourth embodiment differs from the first embodiment in construction in the following points.

Specifically, unlike the first embodiment, the holder 50*b* of the fourth embodiment is not provided with the recess 62 for positioning the cable and the locking portions 60*a* to be engaged with the mating connector (terminal-side connector C44). Instead, projections 67 for positioning the cable are provided at the opposite widthwise ends of the alignment surface 60. Further, cable pressing portions 65 are provided at the outer sides of a rib 64 at the leading end of the alignment surface 60, and slot-shaped inserting portions 65*a* are formed between the cable pressing portions 65 and the alignment surface 60.

An end of the cable 130 is processed to expose conductors 131, and a reinforcing plate 132 for restricting the deformation of the cable end portion is secured to the rear surface of the end portion. Notches 132*a* corresponding to the projections 67 of the holder 50*b* are formed at the opposite widthwise ends of the reinforcing plate 132. Further, fixing pieces 132*b* project at the opposite widthwise ends of the leading end of the reinforcing plate 132.

The cable 130 is mounted on the connector C42 as follows.

First, the cable 130 is passed through the housing 50*a* by inserting the end portion of the cable 130 through the insertion opening 51*a* with the lock piece 54 of the housing 50*a* opened, and the holder 50*b* is placed under the cable 130 in this state. Specifically, the respective fixing pieces 132*b* of the reinforcing plate 132 are inserted into the inserting portions 65*a* of the holder 50*b*, and the cable 130 is placed on the alignment surface 60 of the holder 50*b* while the respective notches 132*a* of the reinforcing plate 132 are engaged with the projections 67 of the holder 50*b*. By doing so, movements of the reinforcing plate 132 in forward and backward directions and transverse direction are restricted by the projections 67, with the result that the cable 130 is positioned with respect to the holder 50*b*.

Figure 30A:
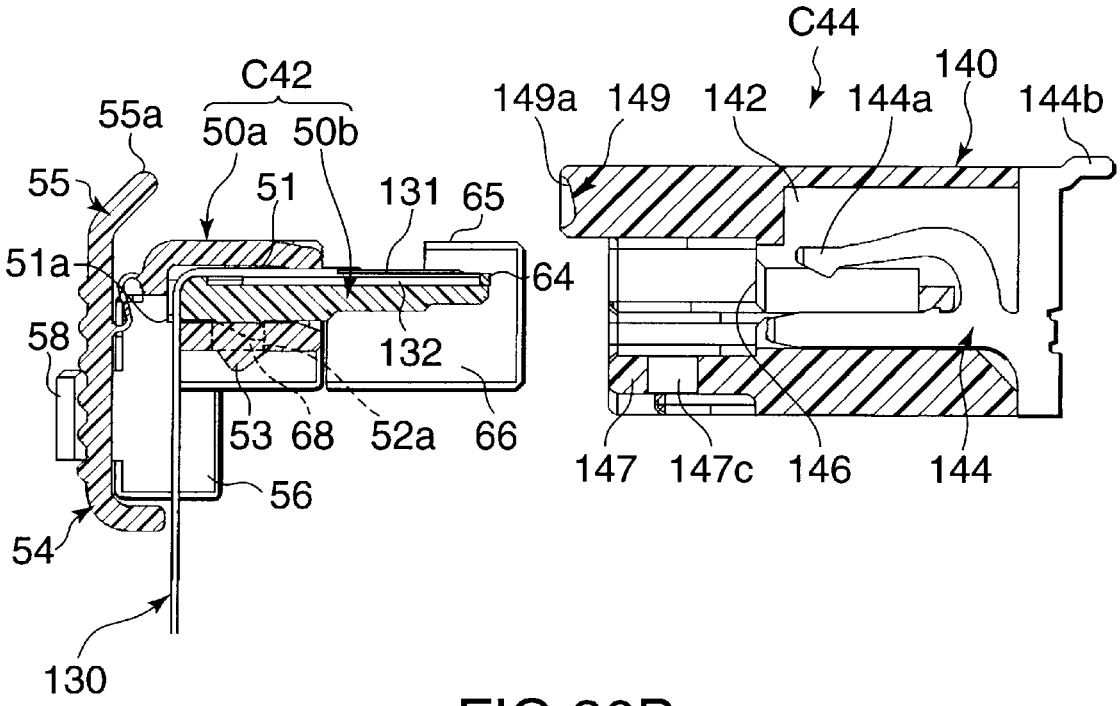
FIGS. 30A and 30B are sectional views showing the connector assembly of the fourth embodiment prior to and after connection of the flat wire member.

Next, the holder 50*b* is inserted into the insertion hole 51 of the housing 50*a* from its rear end (end opposite from the rib 64) in this state. Then, as shown in FIG. 30A, the hooks 68 formed on the rear surface of the holder 50*b* are engaged with the locking holes 52*a* of the housing 50*a* to undetachably lock the holder 50*b* into the housing 50*a*. The lock piece 54 is bent to close the insertion opening 51*a* of the housing 50*a* and is pushed in between the hooks 58, thereby completing the mounting of the cable 130 on the connector C42.

Figure 29:
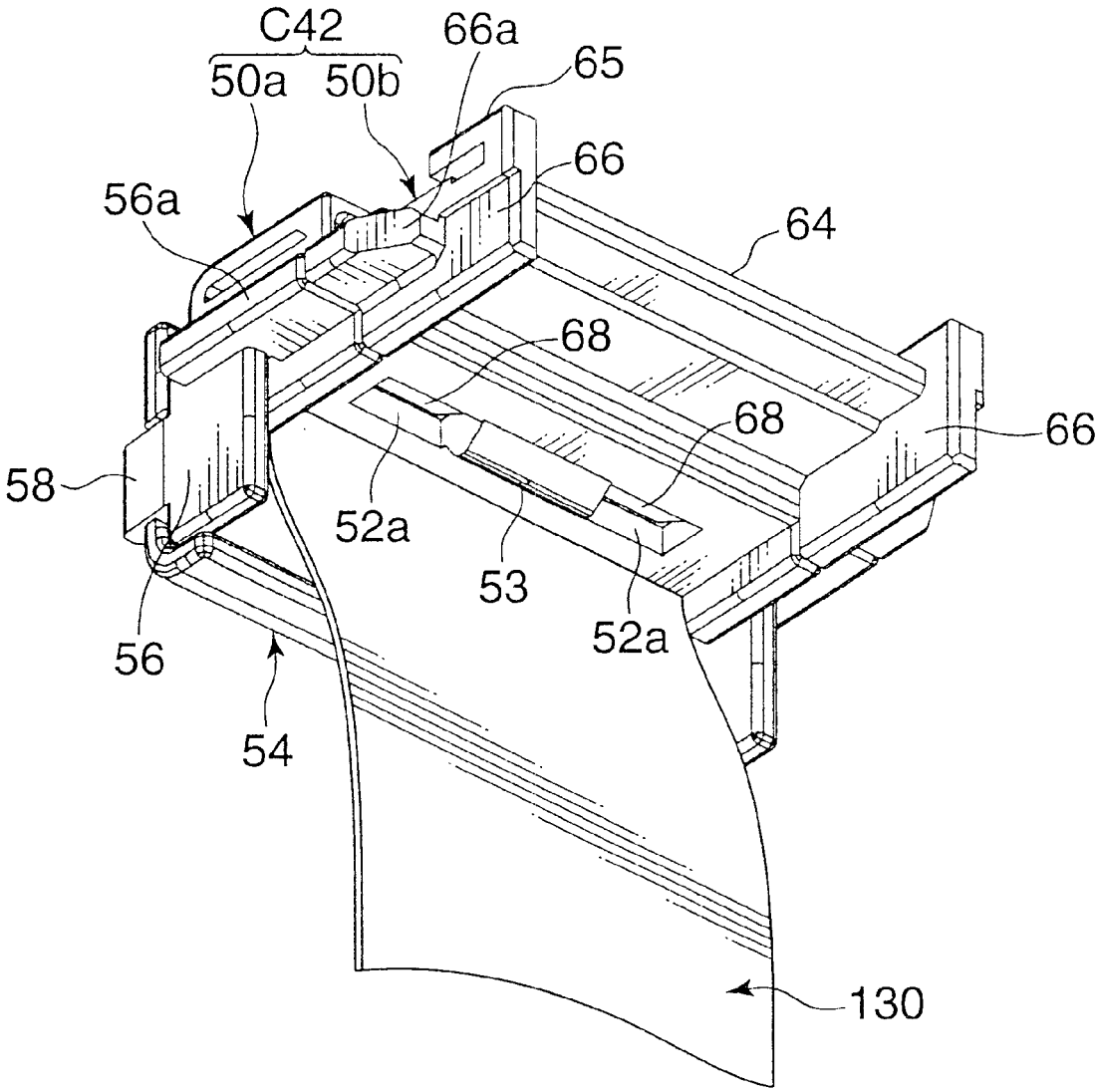
FIG. 29 is a perspective view of the wire-side connector, when being viewed from below.

In this connector C42, a pair of hooks 68 of the holder 50*b* and a pair of corresponding locking holes 52*a* of the housing 50*a* are provided while being spaced apart in the widthwise direction of the connector C42 as shown in FIG. 29, and a hook-shaped locking portion 53 for locking the terminal-side connector C44 is formed between the respective locking holes 52*a* of the housing 50*a*.

Figure 27:
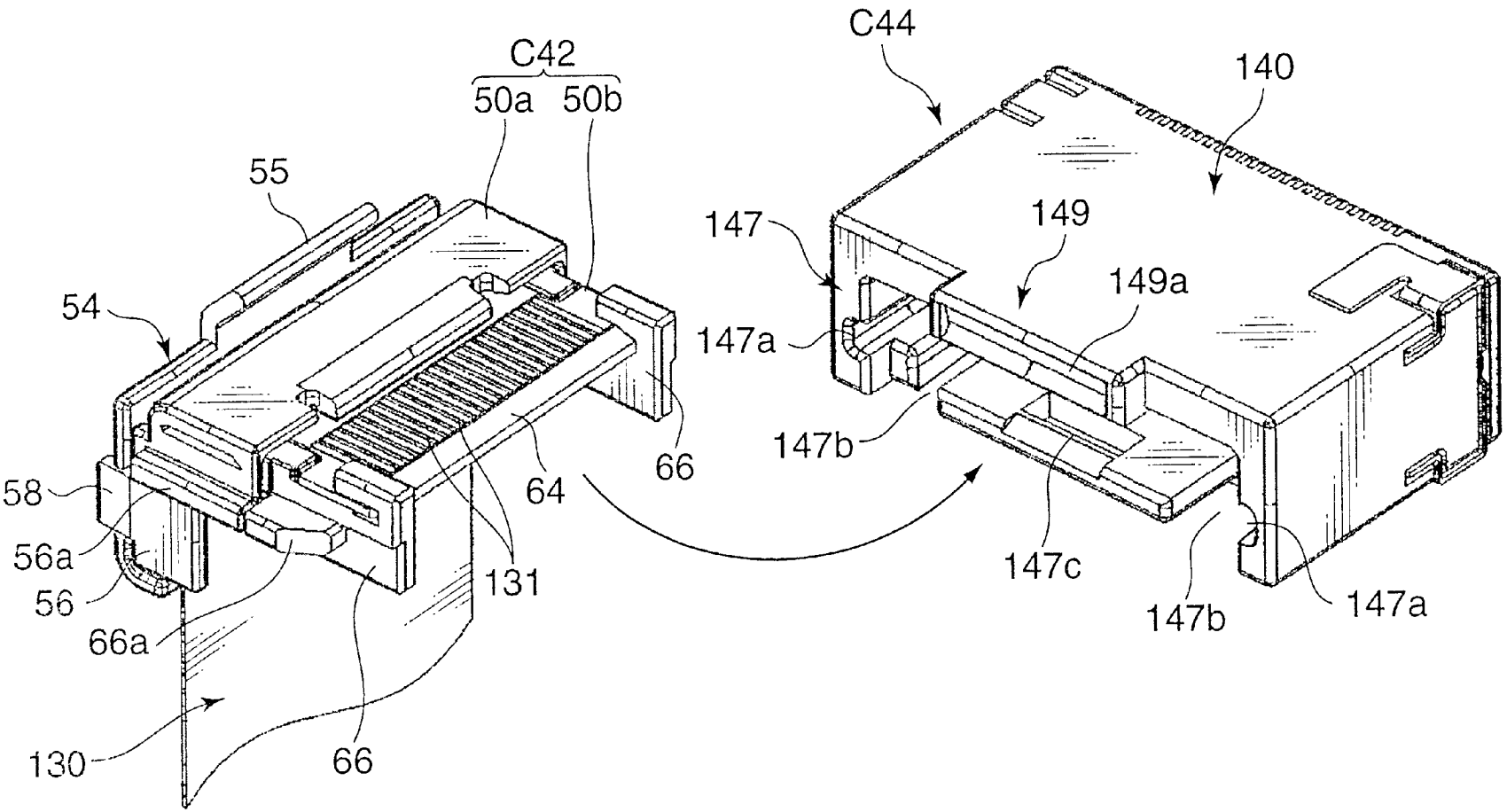
FIG. 27 is a perspective view showing a connector assembly for flat wire member according to a fourth embodiment of the invention.

Further, elongated projections 56*a*, 66*a* are formed at the opposite sides of the housing 50*a* and the holder 50*b* and, when the holder 50*b* is mounted into the housing 50*a*, these elongated projections 56*a*, 66*a* cooperatively form guiding portions (guiding portions when the connector C42 is fitted into the terminal-side connector C44) extending in forward and backward directions (connector connecting direction) as shown in FIGS. 27 and 29.

On the other hand, the terminal-side connector C44 (hereinafter, "connector C44") has a long and narrow housing 140 as shown in FIG. 27, and a multitude of terminal cavities 142 arrayed in longitudinal direction are formed inside the housing 140 and have terminals 144 accommodated therein as shown in FIG. 30A. Each terminal 144 includes a deformable piece 144*a* for connection extending in forward and backward directions and a leg portion 144*b* extending toward a rear upper part of the housing 140. The respective terminals 144 are electrically connected with circuits on the circuit board by being soldered to a fixing land or the like (not shown) on the circuit board.

An insertion opening 146 for the cable 130 is provided at the front surface of the housing 140, and a tubular hood 147 is integrally formed around the insertion opening 146. A cam follower 149 having a slide surface 149*a* for the cam member 55 is formed at the upper front end of the hood 147. Guide grooves 147 corresponding to the guiding portions (elongated projections 56*a*, 66*a*) of the connector C42 are formed in the inner side surfaces of the hood 147, and slits 147*b* for guiding the guides 66 of the connector C42 and a locking hole 147*c* corresponding to the locking portion 53 are formed in the bottom wall of the hood 147.

Figure 30B:
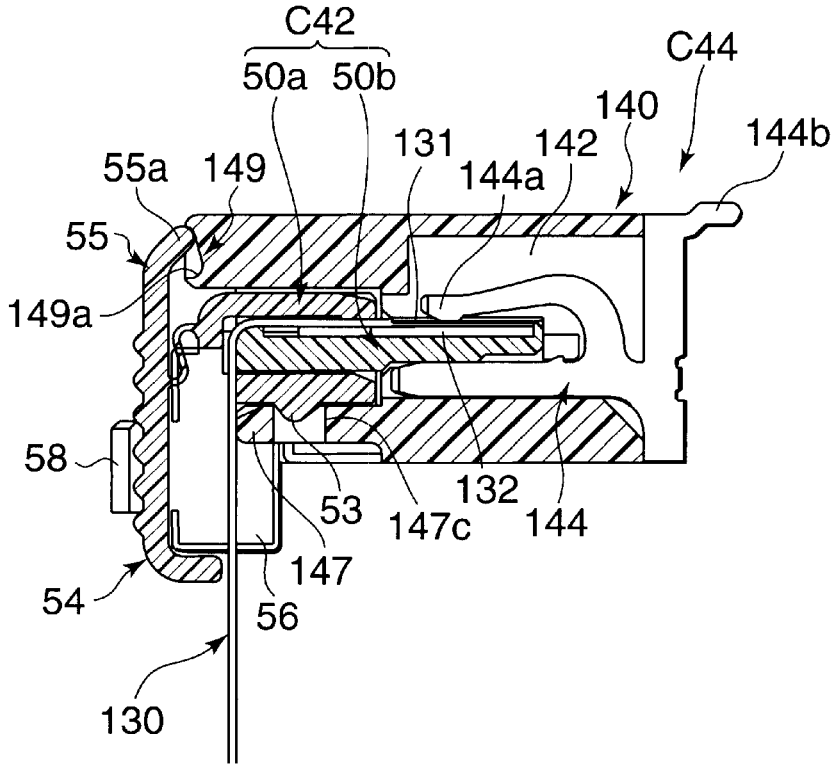

In the fourth embodiment thus constructed, when the connector C42 is placed to face the insertion opening 146 of the connector C44 as shown in FIG. 30A and the connector C42 is inserted into the housing 140 (through the insertion opening 146) of the connector C44 from the leading end of the holder 50*b*, the housing 50*a* of the connector C42 is fitted into the hood 147 of the connector C44 as shown in FIG. 30B, the exposed sections of the conductors 131 of the cable 130 are held in contact with the deformation pieces 144*a* of the respective terminals 140, and the locking portion 53 of the connector C42 enters the locking hole 147*c* of the hood 147 to lock the housings of the connectors C42, C44 into each other. When the two connectors C42, C44 are thus connected, the cam member 55 (slidable portion 55*a*) of the lock piece 54 of the connector C42 is in contact with the cam follower 149 (slide surface 149*a*) of the connector C44.

When the lock piece 54 is unlocked to detach the connector C42 in this state, the connector C42 is withdrawn from the connector C44 as the lock piece 54 is pivoted. The locking portion 53 is tapered from its base end toward its leading end, thereby being substantially trapezoidal in side view. Accordingly, this locked state of the connectors C42 and C44 is a so-called "semi-locked" state and, upon action of a load on the connector C42 in withdrawing direction during the unlocking operation of the lock piece 54 as described above, the connector C42 can be detached from the connector C44 while being unlocked.

In the connectors C42, C44 of the fourth embodiment, since the locking portion 53 is so formed on the bottom surface of the housing of the connector C42 as to be engageable with the hood 147 of the connector C44, there is less restriction on the size of the locking portion(s) as compared, for example, to the connector construction in which the locking portions (60*a*) are provided on the side surfaces of the holder 50*b* as in the first embodiment. Thus, the relatively large locking portion 53 can be provided and the connectors C42, C44 can be more strongly locked into each other by providing the relatively large locking portion 53. Further, since these connectors C42, C44 are provided with the disengaging mechanism, the locked state of the connectors C42, C44 can be relatively easily cleared when the cable 130 is to be detached while enhancing the locking strength as described above.

A fifth embodiment of the present invention is described.

Figure 31:
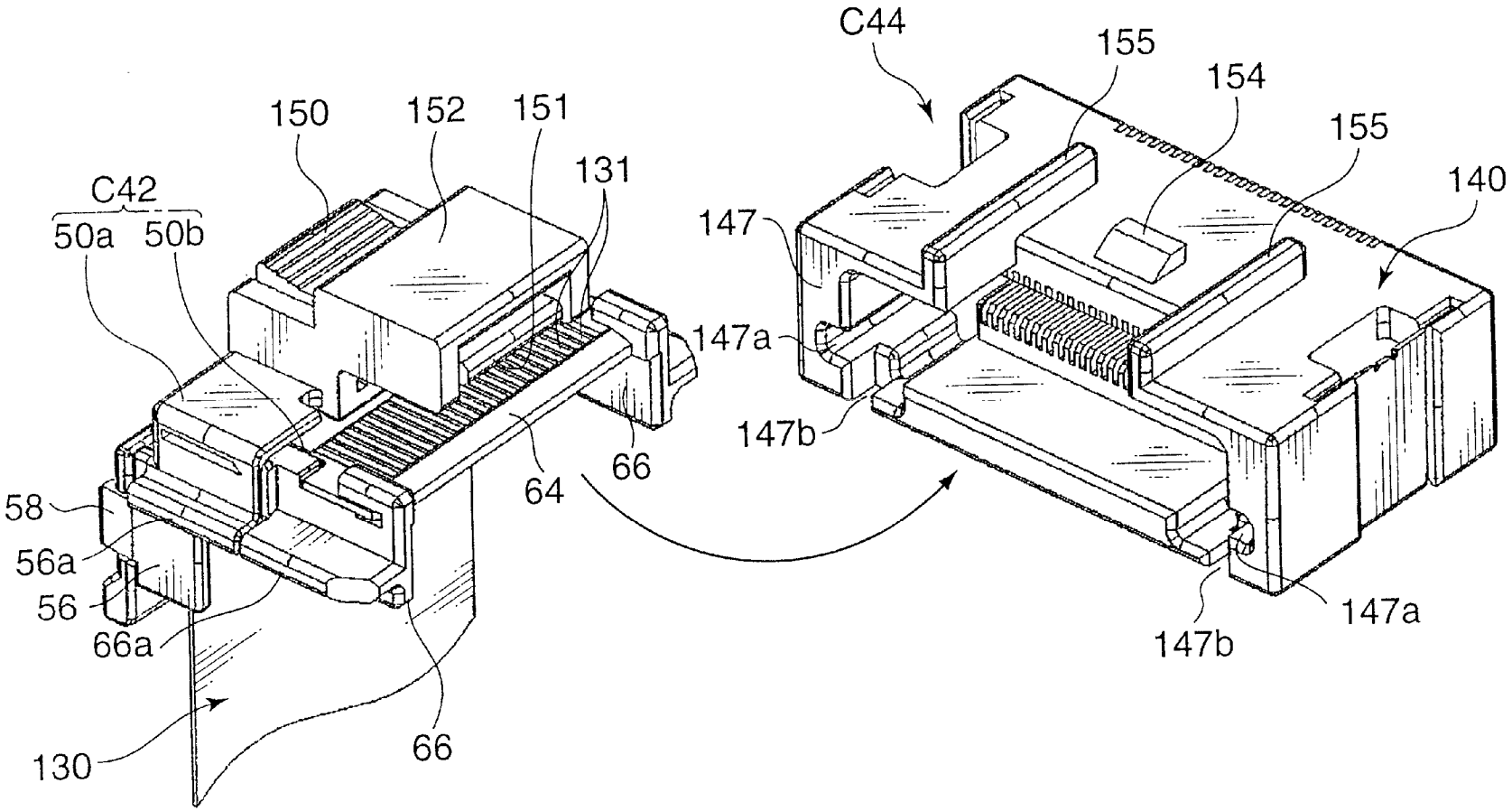
FIG. 31 is a perspective view showing a connector assembly for flat wire member according to a fifth embodiment of the invention.
Figure 32:
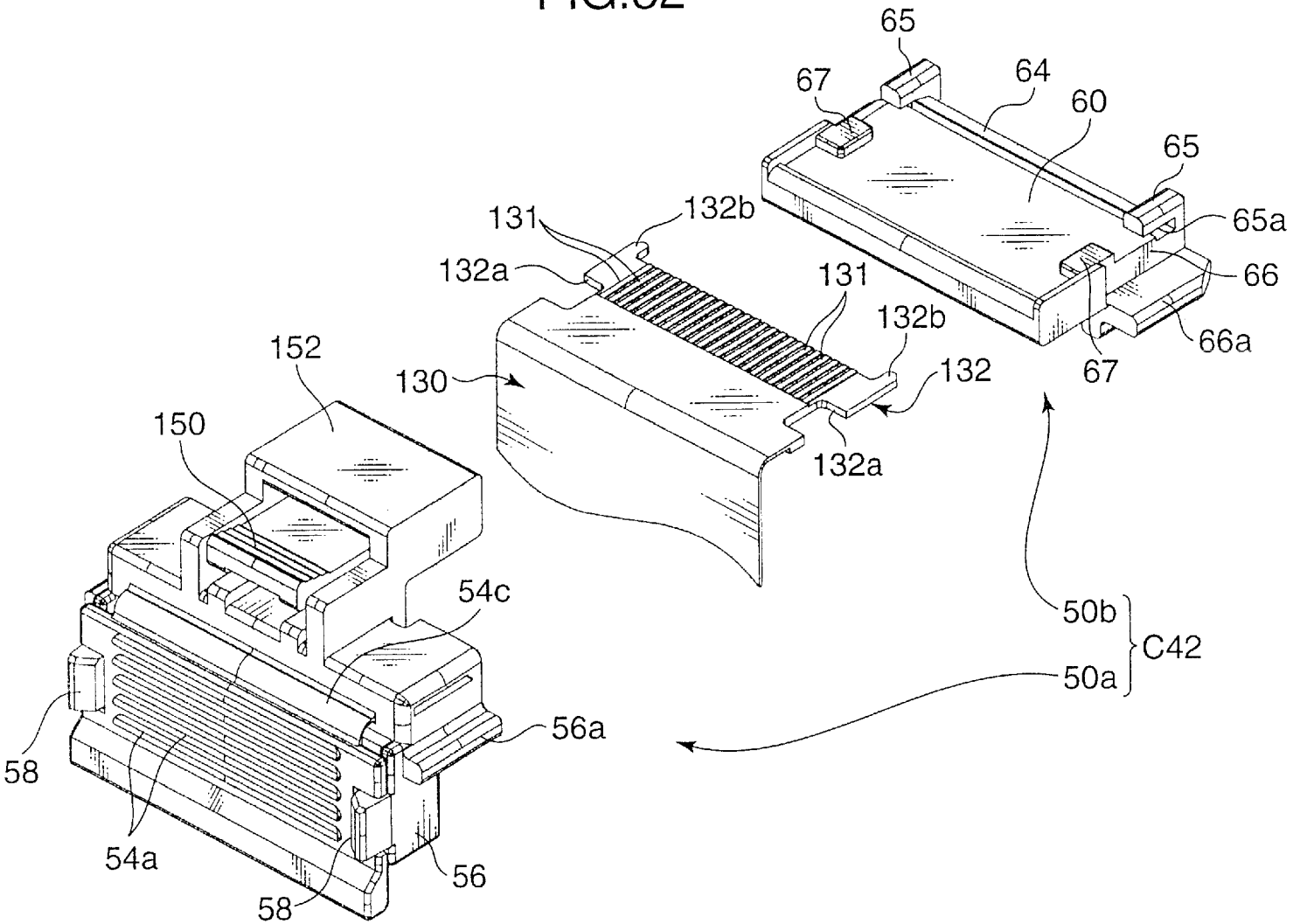
FIG. 32 is an exploded perspective view showing a wire-side connector of the fifth embodiment.
Figure 33A:
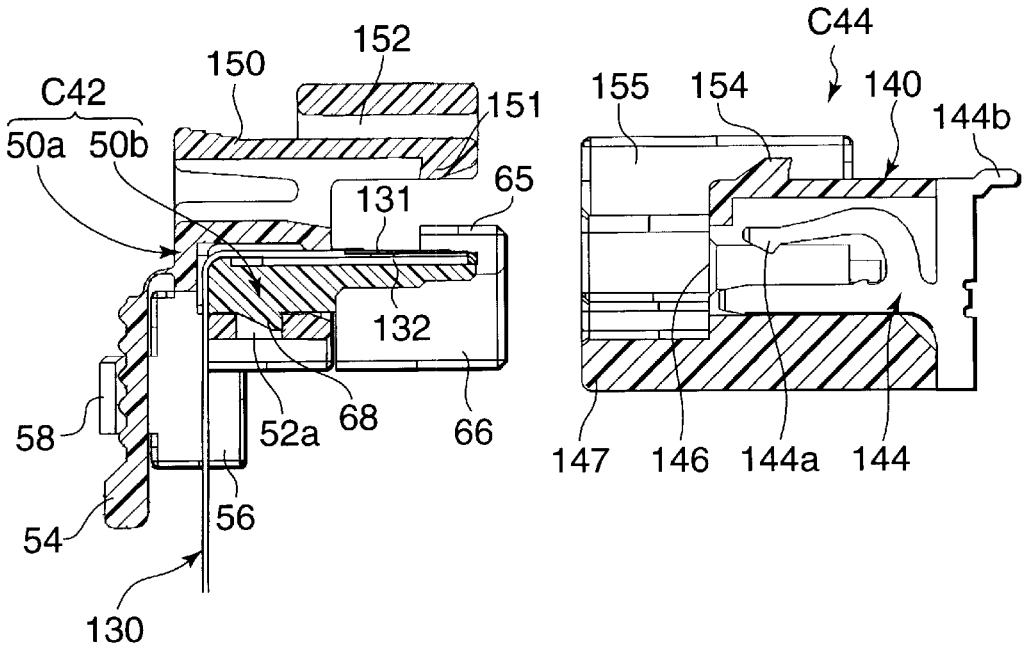
FIGS. 33A and 33B are sectional views showing the connector assembly of the fifth embodiment prior to and after connection of the flat wire member.

FIGS. 31, 32 and 33A show a connector assembly for flat wire member according to the fifth embodiment. Since the basic construction of the connector assembly according to the fifth embodiment is substantially common to that of the fourth embodiment, no description is given below on the elements common to those of the fourth embodiment by identifying them by the same reference numerals and differences between the fourth and fifth embodiments are described in detail.

The connector assembly for flat wire member according to the fifth embodiment is identical to that of the fourth embodiment in construction in that it is comprised of a wire-side connector C42 to be mounted on an end of the cable 130 and a terminal-side connector C44 to be mounted on a circuit board (not shown).

Unlike the fourth embodiment, the respective connectors C42, C44 of the fifth embodiment are not provided with the disengaging mechanism, and the mechanism for locking the connectors C42, C44 into each other differs from the fourth embodiment as follows.

Specifically, the housing 50*a* of the connector C42 is not provided with the locking portion 53 unlike the fourth embodiment and the lock piece 54 is not provided with the cam member 55. Instead, a tubular guiding portion 152 hollow in forward and backward directions (connector connecting direction) is integrally formed on top of the housing 50*a*, and an operable lever 150 having a hook 151 at its leading end is provided inside the guiding portion 152.

On the other hand, the housing 140 of the connector C44 is provided with neither the locking hole 147*c* nor the cam follower 149 unlike the fourth embodiment. Instead, a pair of ribs 155 for guiding the guiding portion 152 are formed on the upper surface of the housing 140, and a locking portion 154 projects between the ribs 155.

Figure 33B:
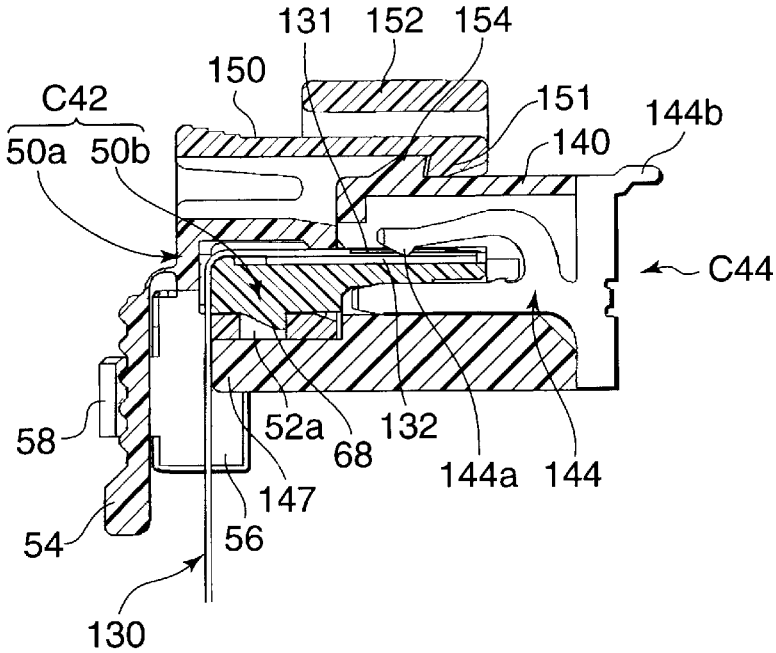

In the construction of the fifth embodiment as described above, as the two connectors C42, C44 are connected with each other, the leading end of the operable lever 150 of the connector C42 is pushed up upon coming into contact with the locking portion 154 of the connector C44. When the two connectors C42, C44 are completely connected, the hook 151 of the operable lever 150 moves over the locking portion 154 to engage the locking portion 154 as shown in FIG. 33B, with the result that the two connectors C42, C44 are locked into each other.

The connector C42 is detached as follows. After unlocking and gripping the lock piece 54 and pivoting the operable lever 150 to disengage the hook 151 from the locking portion 154, the connector C42 is withdrawn. Specifically, the connector C42 is withdrawn with the rear end (end opposite from the hook 151) of the operable lever 150 pushed down, thereby being detached from the connector C44.

In the connectors C42, C44 of the fifth embodiment as well, there is less restriction on the size of the portions (hook 151, locking portion 154) for locking the two connectors C42, C44 as in the fourth embodiment. Accordingly, there can be obtained the effects similar to the fourth embodiment: the two connectors C42, C44 can be securely locked into each other, whereas the connector C42 can be easily detached by pivoting the operable lever 150 to disengage the connectors C42, C44 upon detaching the cable 130.

The connector assemblies for flat wire member described in the first to fifth embodiments are representative embodiments of the present invention, and specific constructions can be suitably changed without departing from the scope of the present invention.

(1) Although the handle (lock piece 54, handle 78) is in form of a thin plate in the first, second, fourth and fifth embodiment, it is not necessarily in the form of a thin plate, but may be, for example, in the form of a bar.

(2) Although the handle (lock piece 54, handle 78) is pivotal between the used position and the accommodated position in the first, second, fourth and fifth embodiment, it may be slidable in the direction in which the connector C22 is connected with the connector C14 and the like).

(3) Although the first slider 92 is comprised of the slider main body 92*a* and the holder 92*b* to be slidably assembled with the slider main body 92*a* in the third embodiment, it may have a single-element construction comprised of only a member corresponding to the slider main body 92*a* and the pivotal handle as in the first and second embodiments may be provided.

(4) The connectors C14, etc. and the connector C22 of the second embodiment may be provided with the disengaging mechanism as shown in the modification (example shown in FIGS. 14 and 15) of the first embodiment.

Figure 34B:
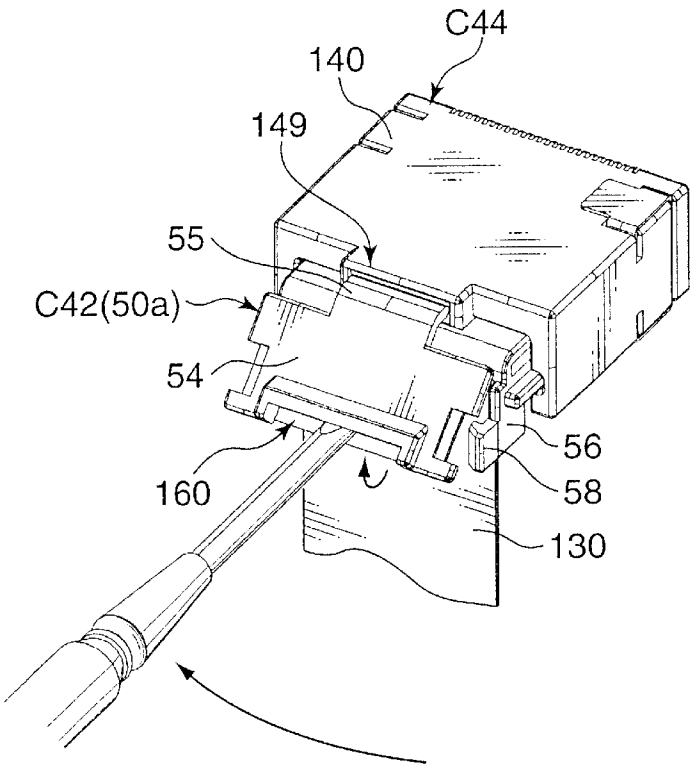
FIGS. 34A and 34B are perspective views showing an example in which the wire-side connector of the connector assembly of the fifth embodiment is provided with a jig insertion portion.
Figure 34A:
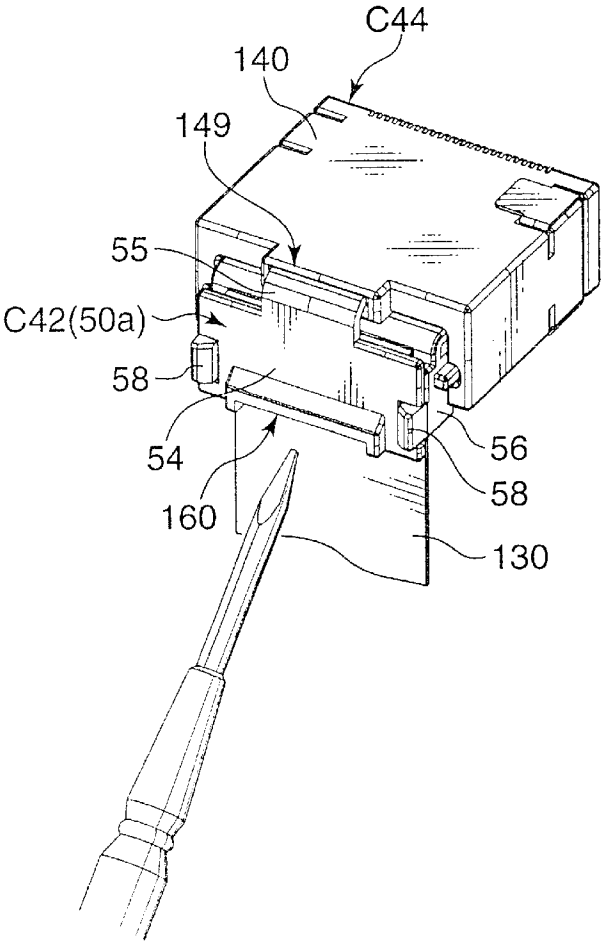

(5) In the connector C42 of the fourth embodiment, the lock piece 54 may be formed with a hollow jig insertion portion 160 as shown in FIG. 34A and may be unlocked using a driver or a like jig as shown in FIG. 34B in a narrow space where fingertips cannot be used. This construction is also applicable to the first, second and fifth embodiments. Further, the holder 92*b* may be provided with the jig insertion portion in the third embodiment.

Although the present invention is applied to an electrical connection construction of an audio unit installed in a vehicle in the foregoing embodiments, it is, of course, also applicable to an other electrical connection construction such as the one for an electrical unit.

Although the flat cables (15, 17, 19, etc.) are used as flat wire members in the foregoing embodiments, the flat wire members are not limited to flat cables. Ribbon wires, FPCs (flexible printed circuits) and the like may be used as such.

As described above, an inventive fixture device is used in connection of a flat wire member with a terminal-side connector for accommodating terminals. The fixture is provided with a housing having a shape engageable with the terminal-side connector for holding conductors of a flat wire member in contact with the terminals when the fixture device is placed in the terminal-side connector, and a handle changeable between an accommodated position and a used position and extends in a direction opposite from an engaging direction of the fixture device with the terminal-side connector when being located at the used position.

The fixture device can be made easily grippable by setting the handle provided on the fixture device at the used position during the operation of connecting or detaching the flat wire member. Accordingly, the flat wire member can be more quickly and securely connected and detached in a narrow space by using the handle, thereby improving the operability. Further, The handle is set at the accommodated position except during the operation of connecting or detaching the flat wire member. This is advantageous in that the handle does not hinder other operations by taking up only a small space.

Preferably, a locking mechanism for locking the handle at the accommodated position may be further provided. Such a locking mechanism can effectively prevent the handle to hinder other operations by being inadvertently displaced to the used position and from coming into contact with other parts arranged in proximity.

Preferably, there may be further provided a disengaging mechanism for clearing a connected state of the fixture device and the terminal-side connector as the handle is changed from the accommodated position to the used position.

With such a disengaging mechanism, the connected state of the fixture device and the terminal-side connector is automatically cleared by changing the handle from the accommodated position to the used position when the fixture device is to be detached from the terminal-side connector. Thereafter, the fixture device can be easily detached by gripping the handle. In such a case, the disengaging mechanism particularly includes a power-multiplying mechanism for reducing an operation force used to clear the connected state. Accordingly, the connected state can be cleared with a small operation force and, therefore, the disconnecting operation can be more easily performed. It should be noted that "clear the connected state" means to clear the completely connected state. This clearing is not limited to complete clearing of the connected state, and also includes clearing of the connected state to reach a partly connected state.

Preferably, the handle may be pivotal between the accommodated position and the used position or slidable between the accommodated position and the used position.

In the connector assembly in which the handle is pivotal and the disengaging mechanism is provided, the disengaging mechanism may include a cam provided on the handle and a cam follower provided on the terminal-side connector. The cam comes into contact with the cam follower when the fixture device is connected with the terminal-side connector with the handle set at the accommodated position. The handle is pivoted about a contact position of the cam and the cam follower with the cam and the cam follower held in contact with each other when the handle is changed to the used position in this state. The fixture device and the terminal-side connector are relatively displaced in a disengaging direction as the handle is pivoted.

In such a case, if the handle includes a handle main body at one side of a pivotal point thereof and the cam at the other side, and a dimension between the pivotal point and a distal end of the handle main body is set larger than a dimension between the pivotal point and a distal end of the cam, a so-called leverage can be incorporated as a power-multiplying mechanism into the disengaging mechanism. As a result, the fixture device and the terminal-side connector can be disconnected with a smaller operation force by the action of the leverage.

In the case that the handle is made pivotal, the plate-shaped handle may be formed at a tailing end wall surface at a side of the fixture device opposite from the side thereof to be connected with the terminal-side connector, and may be changeable between the accommodated position where the handle is laid over the tailing wall surface and the used position where the handle is upright with respect to the tailing wall surface. Then, the handle can be provided by a structurally simple construction.

The number of the handle may be one. However, it may be appreciated to provide a pair of handles which are held back-to-back at the used position. This construction is more advantageous in view of strength since the detaching operation can be performed by simultaneously gripping the two handles.

For the easier detaching operation, the handle may be preferable formed with a non-slip configuration on the outer surface thereof.

The housing may be held with a flat wire member in the terminal-side connector. The housing may be made slidable in the connector assembly of the type in which the slider is insertably mounted into the terminal-side connector while being placed on or under an end portion of the flat wire member. Further, the fixture device may be a wire-side connector in the connector assembly constructed such that the flat wire member is inserted into the terminal-side connector by mounting the wire-side connector on the end portion of the flat wire member and connecting the wire-side connector with the terminal-side connector.

The fixture device may be used as the wire-side connector. The wire-side connector includes a plate-shaped holder for supporting an end portion of the flat wire member. The holder is placed in the housing. The handle preferably serves also as a locking member for locking the holder so as not to be disengaged from the housing by closing an insertion opening of the housing with the holder inserted. This construction is rational in that the locking member is used as the handle.

This application is based on patent application Nos. 2001-11327, 2001-40178, and 2001-325339 filed in Japan, the contents of which are hereby incorporated by references.

As this invention may be embodied in several forms without departing from the spirit of essential characteristics thereof, the present embodiment is therefore illustrative and not restrictive, since the scope of the invention is defined by the appended claims rather than by the description preceding them, and all changes that fall within metes and bounds of the claims, or equivalence of such metes and bounds are therefore intended to embraced by the claims.

What is claimed is:

1. A fixture device for connecting a flat wire member with a terminal accommodated in a terminal-side connector having a hood portion, the fixture comprising:

a housing holding an end portion of the flat wire member with portions of conductors of the flat wire member being exposed from the housing, the housing having a shape to be fitted in the hood portion of the terminal-side connector with the exposed portions of the conductors being in contact with the contact arm of the terminal; and a handle interconnected with the housing to move between an accommodated position for accommodating the flat wire member in the housing and a used position to be used for the coupling and decoupling of the housing with the terminal-side connector, the handle at the used position extending in the direction opposite from the direction in which the housing is moved to be coupled with the terminal side-connector.

2. The fixture device according to claim 1, further comprising a locking mechanism for locking the handle at the accommodated position.

3. The fixture device according to claim 1, wherein the handle is slidable between the accommodated position and the used position.

4. The fixture device according to claim 1, wherein a non-slip configuration is formed on an outer portion of the handle such that the outer portion is held by a user for inserting the housing into and pulling the housing out of the terminal side-connector handle.

5. The fixture device according to claim 1, further comprising a plate-shaped supporter for supporting the end portion of the flat wire member, wherein the housing and the plate shaped supporter have a retaining mechanism for retaining the plate shaped supporter to prevent it from moving relative to the housing, and the plate shaped supporter and the flat wire member have a retaining mechanism for retaining the flat wire member to prevent it from moving relative o the plate shaped supporter.

6. The fixture device according to claim 1, further comprising a disengaging mechanism for disengaging the fixture device from the terminal-side connector as the handle is moved from the accommodated position to the used position.

7. The fixture device according to claim 6, wherein the disengaging mechanism includes a power-multiplying mechanism for amplifying an operation force applied thereto to operate the disengaging mechanism.

8. The fixture device according to claim 7, wherein the handle is pivotal between the accommodated position and the used position.

9. The fixture device according to claim 6, wherein the disengaging mechanism includes a cam provided on the handle and configured to come into contact with a portion of the terminal-side connector when the housing of the fixture device is fitted in the hood portion of the terminal-side connector with the handle being set at the accommodated position, and the handle is pivotally connected with the housing to move from the accommodated position to the used position to thereby cause a relative movement of the fixture device and the terminal-side connector in a disengaging direction.

10. The fixture device according to claim 9, wherein the handle includes a handle main body at one side of a pivotal point thereof and the cam at the other side, and a dimension between the pivotal point and a distal end of the handle main body is larger than a dimension between the pivotal point and a distal end of the cam.

11. The fixture device according to claim 10, wherein the handle has a shape of a plate and is provided at the back of the fixture device, and is movable between the accommodated position where the handle lays over the back of the housing and the used position where the handle extends substantially at a right angle to the back of the housing.

12. The fixture device according to claim 11, wherein a pair of handles are provided, and the handles extend back-to-back and adjacent to each other to be gripped simultaneously at the used position.

13. A connector assembly for a flat wire member, comprising:

a terminal-side connector including a hood portion and a terminal Portion having a contact arm; and a fixture device including:

a housing for holding an end portion of the flat wire member with a portion of the conductor of the flat wire member being exposed from the housing, the housing having a shape to be fitted in the hood portion of the terminal-side connector with the exposed conductor being in contact with the contact arm of the terminal; and a handle interconnected with the housing to move between a accommodated position and a used position to be used for the coupling and decoupling of the housing with the terminal side connector, the handle at the used position extending in the direction opposite from the direction in which the housing is moved to be coupled with the terminal-side connector.

14. The connector assembly according to claim 13, the fixture device further includes a locking mechanism for locking the handle at the accommodated position.

15. The connector assembly according to claim 13, further comprising a disengaging mechanism disengaging the housing from the terminal-side connector as the handle is moved from the accommodated position to the used position.

16. The connector assembly according to claim 13, wherein the handle is slidable between the accommodated position and the used position.

17. The connector assembly according to claim 13, wherein a non-slip configuration is formed on an outer portion of the handle to be held by a user for inserting the housing into and pulling the housing out of the terminal side connector.

18. The connector assembly according to claim 13, wherein the terminal side connector includes a plurality of terminals, each terminal having a first contact arm, and the flat wire member has a plurality of wirings for respective contact and electrical connection with the first contact arms of the terminals.

19. The connector assembly according to claim 18, further comprising a printed circuit board, and wherein each terminal further has a leg portion for electrical connection with the printed circuit board.

20. The connector assembly according to claim 18, wherein the connector assembly is arranged to receive a second flat wire member having a plurality of wirings and each terminal has a second contact arm to be in contact with the wiring of the second flat wire member.

21. The connector assembly according to claim 13, wherein the housing and the terminal side connector have a retaining mechanism for releasably retaining the housing to the terminal side connector.

22. The connector assembly according to claim 13, wherein the flat wire member has a first end portion and second end portion, the terminal side connector has a first hood portion and second hood portion, the fixture includes a first plate shaped supporter and a second plate shaped supporter for respectively supporting the first and second end portions of the flat wire member, and a first handle and a second handle for respectively retaining the first and second end portions of the flat wire member within the housing, and the first and second end portions of the flat wire member are respectively inserted into the first and second hood portions.

* * * * *